US005918087A

United States Patent [19]

Kimura et al.

[11] Patent Number: 5,918,087

[45] Date of Patent: Jun. 29, 1999

[54] IMAGE FORMING APPARATUS

[75] Inventors: Yoshiyuki Kimura; Hiroshi Hosaka, both of Tokyo, Japan

[73] Assignee: Ricoh Company, Ltd., Tokyo, Japan

[21] Appl. No.: 08/896,650

[22] Filed: Jul. 18, 1997

[30] Foreign Application Priority Data

Jul. 19, 1996 [JP] Japan ..... 8-191172
Jul. 19, 1996 [JP] Japan ..... 8-191173

[51] Int. Cl.[6] ..... G03G 15/20

[52] U.S. Cl. ..... 399/69

[58] Field of Search ..... 399/67, 69, 320, 399/321, 328, 330, 331, 335

[56] References Cited

U.S. PATENT DOCUMENTS

| | | | |
|---|---|---|---|
| 4,373,801 | 2/1983 | Itoh | 399/69 X |
| 4,549,803 | 10/1985 | Ohno et al. | 399/67 X |
| 4,977,431 | 12/1990 | Fuji | 399/69 |
| 5,001,519 | 3/1991 | Saito | 399/69 |
| 5,049,906 | 9/1991 | Kobayashi et al. | 399/67 X |
| 5,073,801 | 12/1991 | Haneda et al. | 399/69 X |
| 5,512,992 | 4/1996 | Kim et al. | 399/69 |
| 5,568,229 | 10/1996 | Szlucha | 399/67 X |

FOREIGN PATENT DOCUMENTS

| | | |
|---|---|---|
| 4-287077 | 10/1992 | Japan . |
| 8-79476 | 3/1996 | Japan . |

*Primary Examiner*—Sandra Brase
*Attorney, Agent, or Firm*—Oblon, Spivak, McClelland, Maier & Neustadt, P.C.

[57] ABSTRACT

An image forming apparatus including a fixing roller and a pressure roller in which a temperature of the fixing roller and/or the pressure roller is changed differently depending on an operation mode. In particular, the temperature of the fixing roller and/or pressure roller of an operation of a non-full color mode is changed to a lesser degree than that of a full color mode operation. In another embodiment of the present invention, the temperature of the fixing roller is set to an appropriate value when an environment temperature sensor is not working properly, to produce high quality images. In yet another embodiment according to the present invention, the temperature of the fixing roller is set to an appropriate value, when an image forming apparatus is turned off for a predetermined period of time, to produce high quality images.

63 Claims, 17 Drawing Sheets

IMAGE FORMING APPARATUS

BACKGROUND OF THE INVENTION

1. Field of the Invention

The present invention relates to a fixing device for an image forming apparatus such as a copier, printer, facsimile machine, or similar electrophotographic image forming apparatus. More particularly, the invention is concerned with setting the proper temperature of a fixing roller and pressure roller to produce high quality images.

2. Discussion of the Background

A background image forming apparatus includes a heat roller and an additional roller between which a sheet is fed in order to fix an image thereupon. The heating roller generally contains a heating mechanism which is used to heat the heating roller. In addition, heat sensors or the like are used to determine the temperature of the heating roller and this information is used to control a temperature of the heating roller. For example, in a full color copy mode, the temperature of the heater roller is set to a higher temperature than for a monochromatic copy mode.

FIG. 1 is a graph illustrating a reference environment temperature (ambient temperature) versus a set temperature of a fixing roller used by a background printer. The reference environment temperature is the temperature of the environment the image forming apparatus is operating in and is detected by a sensor or the like. For example, as shown in FIG. 1, when the reference temperature is 20° C. (ambient temperature), the set temperature of the fixing roller in a full color mode (line Ta) is 160° C. Similarly, for a reference temperature of 20° C. the set temperature of the fixing roller in a monochromatic mode or a thick paper mode (line Text) is 140° C. If the reference temperature was to increase, it can be seen in FIG. 1 that the slopes of lines Ta and Text decrease, and therefore the set temperature of the fixing roller is decreased. The line Ta shows a relationship between the reference environment temperature and a set temperature of the fixing roller for a full color mode and the line Text shows the same relationship for a monochromatic or thick paper mode. The line Twait is the temperature of the fixing roller set for a standby state, that is, when the apparatus is not in a copy mode. The set temperatures of the lines Ta and Twait are predetermined by a mathematical procedure based on the reference environment temperature.

In order to prevent improper fixing from occurring in the full color mode, a difference of temperature between a highest and lowest temperature $\Delta T$ equals 16°. In this case, the highest temperature for the full color mode would be 168° C. and the lowest temperature would be 152° C. However, as is shown in FIG. 1, the background device also sets the monochromatic or thick paper mode temperature gradient to 16°. Consequently, when the reference environment temperature is relatively low, that is below the ambient temperature of 20°0 C., the set temperature of the fixing roller is increased. This creates a problem in that the temperature is increased too much which results in an offset or luster appearance on the final image. On the other hand, if the reference temperature increases (e.g., above 20° C.), the set temperature is decreased too much resulting in an improper fixing of the image for the monochromatic or thick paper copying mode.

In addition, in the case of the background copier apparatus, when the temperature sensor is out of order or not functioning properly, the copying process must be halted and the temperature sensor replaced.

SUMMARY OF THE INVENTION

Accordingly, it is an object of this invention to provide an image forming apparatus that solves the aforementioned drawbacks.

It is another object of this invention to provide an image forming apparatus which can fix an image of good quality for all types of operation modes selected.

It is yet another object of this invention to provide an image forming apparatus which can continue an operation of producing copies efficiently when a temperature sensor is not working properly.

In order to achieve the above-mentioned and other objects, according to the present invention, an image forming apparatus includes a fixing device which has a fixing roller and a pressure roller and a reference environment sensor which detects a reference environment temperature. In addition, a controller is used to control the heater of a fixing roller and/or a pressure roller based on a signal from the sensor and in accordance with a predetermined set temperature dependent upon an operation mode. To accomplish these tasks, the set temperatures of the fixing roller and/or pressure roller is changed based on the reference environment temperature differently for the full color mode compared to the other modes, such as a monochromatic mode.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
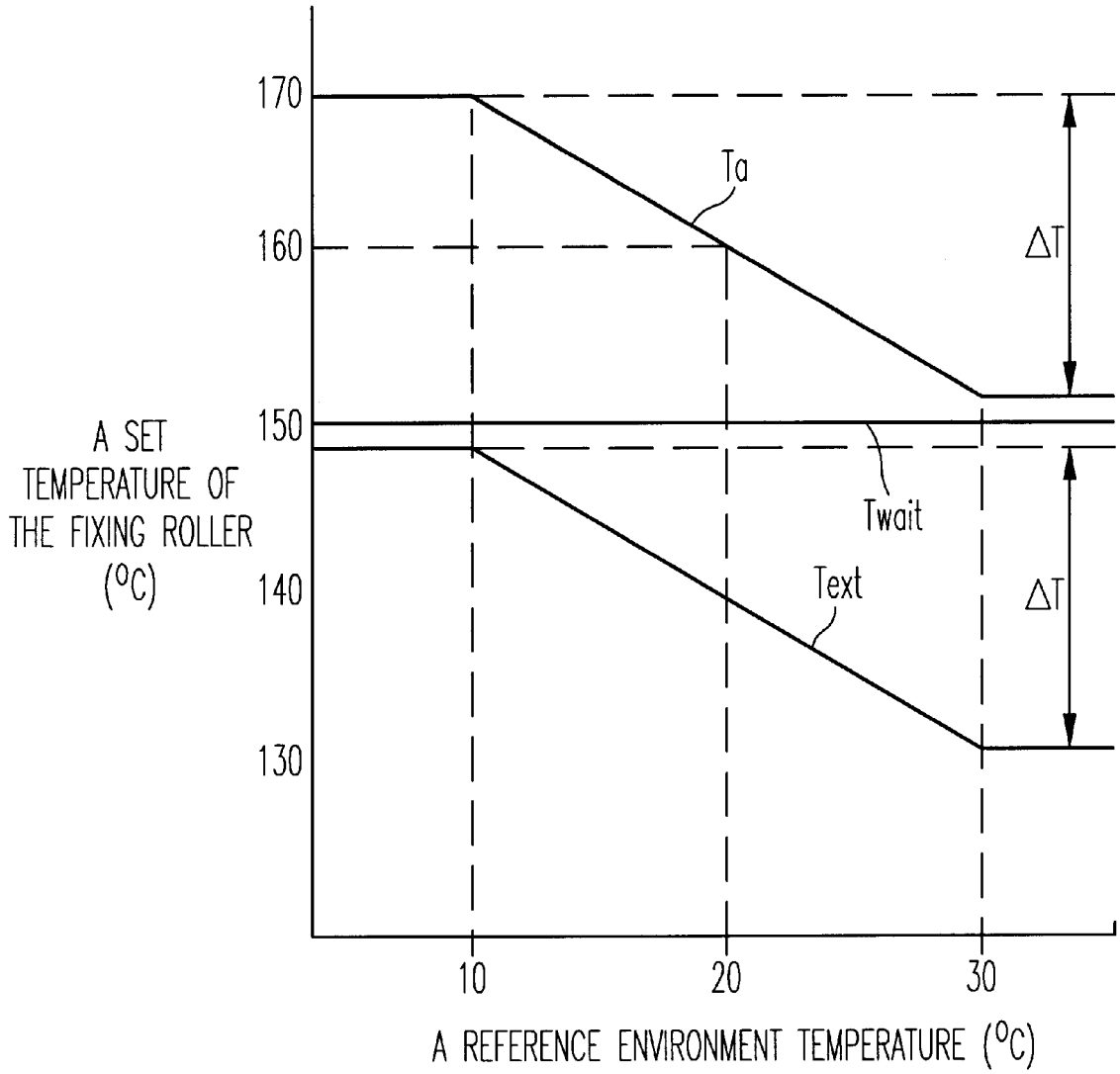
FIG. 1 BACKGROUND ART
FIG. 1 is a graph illustrating a reference environment temperature versus a set temperature of a fixing roller for a background printer.

Referring now to the drawings wherein like reference numerals designate identical or corresponding parts throughout the several views, preferred embodiments of the image forming apparatus in accordance with the present invention will now be described. The embodiments are implemented as an electrophotographic color printer by way of an example only.

Figure 2:
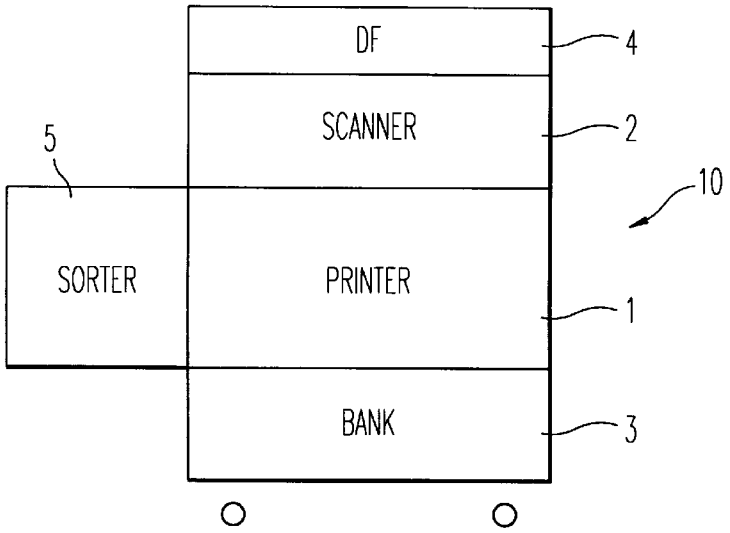
FIG. 2 is a block diagram schematically showing a basic construction of a printer in accordance with the present invention.

First, reference will be made to FIG. 2 for describing a basic construction of a color printer. As shown, the overall printer 10 includes a printer 1, a scanner 2, a sheet feed device or bank 3, a document feeder (DF) 4, and a sorter 5. The printer 1 performs color image formation based on an electrophotographic process. The scanner 2 transfers image data read from a document to the printer 1. The bank 3 feeds sheets to the printer 1 and the DF 4 feeds documents to the scanner 2. The sorter 5 sorts or otherwise processes the sheets driven out of the printer 1.

Figure 3:
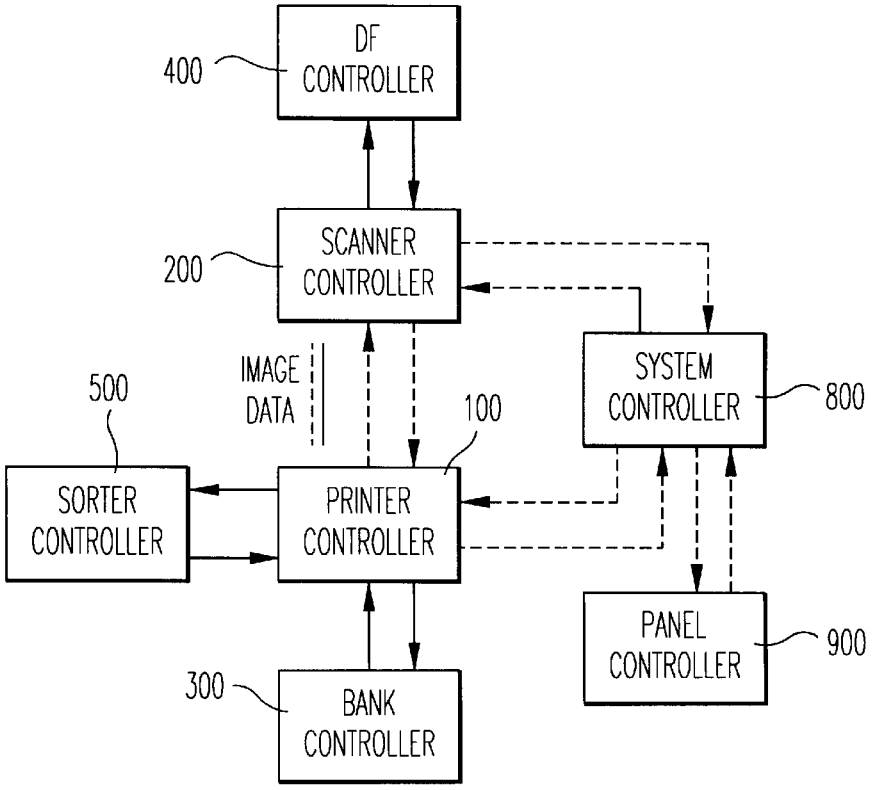
FIG. 3 is a block diagram schematically showing a control system included in the printer of FIG. 2.

FIG. 3 shows a control system used in the printer 10. The control system has a printer controller 100, a scanner controller 200, a bank controller 300, a DF controller 400, and a sorter controller 500, respectively, assigned to the associated sections of FIG. 2. Also shown in FIG. 3 are a system controller 800 and a panel controller 900.

The printer controller 100 controls an electrophotographic process sequence and the sheet transport processing. The printer controller 100 is connected to the bank controller 300 and sorter controller 500 by, for example, optical fiber serial communication, and executes controls in response to preselected commands in unison with image formation. In addition, the scanner controller 200 controls the reading of image data from a document. Further, the scanner controller 200 is connected to the DF controller 400 by, for example, optical fiber serial communication and controls a document feed sequence in response to preselected commands.

The system controller 800 controls the entire system of the printer 10. The system controller 800 transfers image forming conditions to the printer controller 100 and scanner controller 200 in response to commands input from the operation panel controller 900. In addition, the system controller 800 controls the statuses of the entire system and outputs display commands. Further, the system controller 800 is connected to the various controllers by, for example, optical fiber serial communication. The panel controller 900 transfers commands input by the operator to the system controller 800 and displays the statuses of the system and messages in response to commands output from the system controller 800.

Since the register of image components of different colors and the register of a paper and an image should each be accurate, the printer controller scanner controller 200 is connected to the system controller 800 and the printer controller 100, for example, by optical serial communication, so that sequence controls can be properly executed. Also provided in the control system is a data bus which allows image data to be directly transferred from the scanner controller 200 to the printer controller 100.

Figure 4:
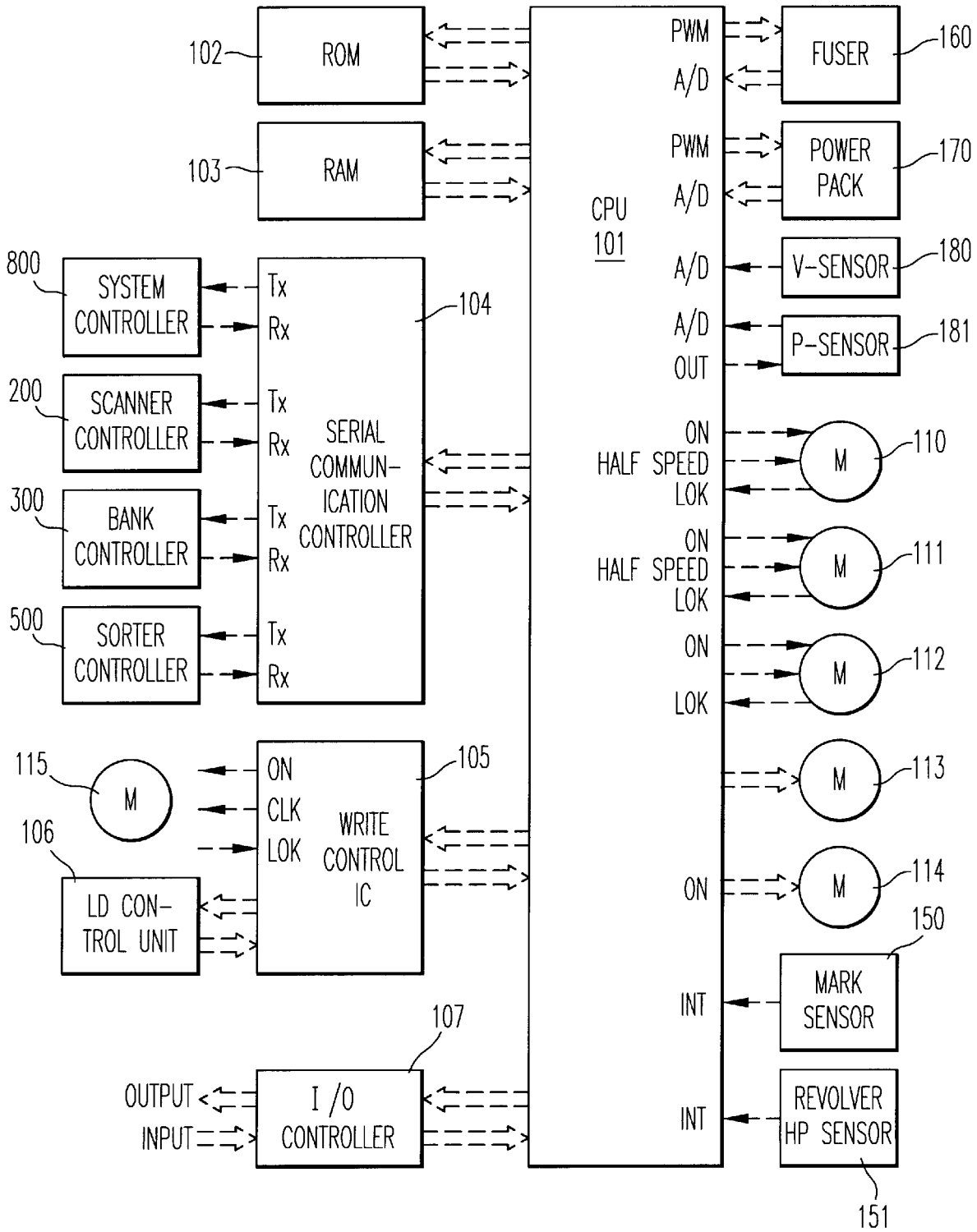
FIG. 4 is a block diagram schematically showing in detail a printer controller included in the control system of FIG. 3.
Figure 5:
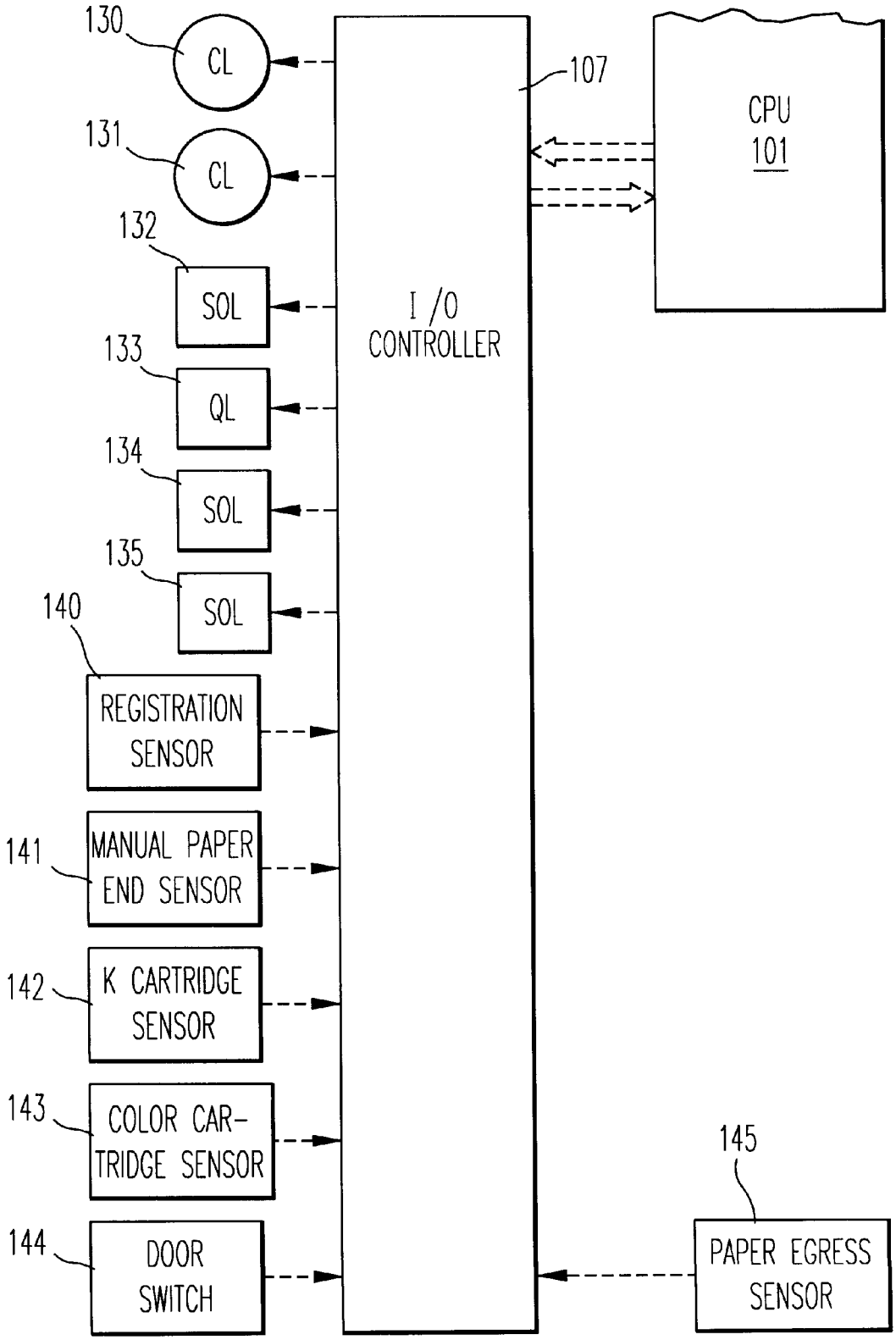
FIG. 5 is a block diagram schematically showing a relation between an I/O (Input/Output) controller shown in FIG. 4 and peripheral units.

FIGS. 4 and 5 show the printer controller 100 in detail. As shown, the functions assigned to the printer controller 100 are implemented by a CPU (Central Processing Unit) 101, a ROM (Read Only Memory) 102, a RAM (Random Access Memory) 103, a serial communication controller 104, a write control IC (Integrated Circuit) 105, an LD (Laser Diode) control unit 106, an I/O ( (Input/Output) controller 107, and various kinds of sensors (not shown). The components of the printer controller 100 will be described specifically hereinafter.

The CPU 101 computes and executes the contents of a program and controls the entire printer controller 100. The ROM 102 stores a control program, while the RAM 103 stores and saves data. The CPU 101, the ROM 102 and RAM 103 are interconnected by a data bus and an address bus. The serial communication controller 104 interchanges commands with the scanner controller 200, bank controller 300, sorter controller 500 and system controller 800 shown in FIG. 3. In addition, the serial communication controller 104 is connected to the CPU 101 by a data bus and an address bus. The write control IC 105 controls exposure, i.e., the LD control unit 106 and a polygon motor 115. The I/O controller 107 controls the input and output between the various sections of the printer 10 and the CPU 101.

A fuser 160 performs PWM (Pulse Width Modulation) output in order to control a heater, discussed later, on the basis of a digitized output of a thermistor (not shown). A power pack unit 170 performs PWM control over the output of a power pack (not shown), on the basis of a digitized output of the power pack fed back thereto. The power pack unit 170 outputs a bias, that is, a DC bias and AC bias, for development as well as voltages which are to be applied to a main charger, charge grid, belt transfer charger, and sheet transfer charger which are described later. An electrometer circuit or V-sensor 180 senses the surface potential of a photoconductive drum shown in FIG. 6. The output of the V-sensor 180 is connected to an A/D (Analog-to-Digital) input included in the CPU 101. An optical sensor circuit or P-sensor 181 is responsive to the amount of toner deposited on the photoconductive drum. A photo transistor included in the P-sensor 181 delivers its output to another A/D input of the CPU 101. The PWM output of the CPU 101 is connected to a driver for driving an LED (Light Emitting Diode) also included in the P-sensor 181.

A main motor 110 drives a sheet transport system used in the printer 10. A drum motor 111 drives the photoconductive drum and an intermediate transfer belt shown in FIG. 6. Further, a development motor 112 drives developing sleeves shown in FIG. 6. The CPU 101 sends an ON signal and a half-speed signal for halving a rotation speed to each of the motors 110–112. In addition, each of the motors 110–112 transfers to the CPU 101 a constant rotation signal (Lok) showing that the motor has reached a target rotation speed. A revolver motor 113 drives the revolver which includes the developing sections shown in FIG. 6. The CPU 101 sends a four-phase output thereof to the revolver motor 113 in order to bring a necessary color for the development to a preselected developing position. A replenishment motor 114 is used to replenish toner from a toner cartridge to a developing section associated therewith. The ON time of the motor 114 is controlled in accordance with the amount of toner deposition.

A mark sensor 150 senses a reference mark provided on the intermediate transfer belt as a reference for color register. Since the output of the mark sensor 150 should be extremely accurate in timing, it is connected to an interrupt input (Ins) included in the CPU 101. A revolver home position (HP) sensor 151 is responsive to a revolver home position which is the reference stop position of the revolver. The output of the HP sensor 151 is connected to another interrupt input (Ins) of the CPU 101, because the output pulse must be switched while the revolver is in rotation.

FIG. 5 shows a relation between the I/O controller 107 and various peripheral units. As shown, the I/O controller 107 delivers signals to a registration clutch 130, a manual insertion clutch 131, a manual insertion pick-up solenoid 132, a discharge lamp 133, a solenoid 134 for the selective contact of the intermediate transfer belt, and a solenoid 135 for lubricant application. The I/O controller 107 receives the outputs of a registration sensor 140, a manual insertion paper end sensor 141, a black cartridge sensor 142, a color cartridge sensor 143, a door switch 144 which is responsive to an open/close position of a door mounted on the printer body, and a paper egress sensor 145.

An arrangement of the printer 1 will be described with reference to FIG. 6. As shown, the printer 1 is generally made up of a photoconductive drum or image carrier 11, a revolver or developing device 20, intermediate transfer belt 30, and a writing unit or laser optics 40.

Arranged around the drum 11 is a discharge lamp or quenching lamp (QL) 18, a main charger (CH) or charging unit 12, an electrometer 13, an optical sensor 14, a pretransfer Lamp (PTL) 15, a belt transfer charger 16, and a drum cleaner 17. The QL 18 dissipates charge remaining on the drum 11 after the image is transferred therefrom. The electrometer 13 measures the surface potential of the drum 11. The sensor 14 reads the density of an image formed on the drum 11. The PTL 15 lowers the surface potential of the drum 11 before an image is transferred thereto. The belt transfer charger 16 deposits a positive charge on the belt 30. The drum cleaner 17 removes toner left on the drum 11 after an image is transferred therefrom. Both the drum 11 and belt 30 are driven by the drum motor 111 shown in FIG. 4.

The revolver 20 contacting the drum 11 has its interior partitioned into four compartments or developing sections 21Y, 21M, 21C and 21K. Letters Y, M, C and K stand for yellow, magenta, cyan and black, respectively. The developing sections 21Y, 21M, 21C and 21K support rotatable developing sleeves 22Y, 22M, 22C and 22K, respectively. The sleeves 22 are each driven by the development motor 112 shown in FIG. 4. Toner cartridges, not shown, each storing toner of a particular color are removably held in the developing sections 21K, 21C, 21M or 21Y, respectively. Specifically, each toner cartridge is positioned in close proximity to the associated developing section and is movable in an interlocked relation to the developing section. The developing position assigned to the revolver 20 is located between the potential sensor 13 and the optical sensor 14 with respect to the periphery of the drum 11. In FIG. 6, the revolver 20 is shown as having its developing section 21K located at the developing position which is by way of an example only. The revolver 20 is rotated by the revolver motor 113, shown in FIG. 4, in the direction indicated by an arrow C. The CPU 101, shown in FIG. 3, controls the rotation of the revolver motor 113 with a four-phase output, so that a necessary color for development is brought to the developing position. The revolver HP position 151 senses the home position of the revolver 20, as was previously discussed.

The writing unit 40 includes a polygonal mirror 116 rotated by a polygon motor 115, an f-θ lens 117, and a mirror 118. A laser beam issuing from a light source, e.g., laser diode (not shown), is steered by the polygonal mirror 116, passed through the f-θ lens 117, reflected by the mirror 1 18, and then incident to the surface of the drum 11 which is uniformly charged by the main CH 12. The position where the laser beam is incident to the drum 11 is between the main CH 12 and the electrometer 13.

Arranged around the intermediate transfer belt 30 are the mark sensor 150, a lubricant application unit 32, a sheet transfer charger 33, and a belt cleaner 34. The mark sensor 150 senses a mark, not shown, provided on the inner periphery of the belt 30 and serves as a reference for color registration. The lubricant application unit 32 applies a lubricant to the belt 30. The sheet transfer charger 33 transfers an image transferred from the drum 11 to the belt 30 to a sheet, not shown. The belt cleaner 34 removes the toner remaining on the belt 30. During image formation, the belt 30 and drum 11 contact each other at the position where the belt transfer charger 16 is located. When the two rollers 119 and 120 are shifted, the belt 30 is released from the drum 11, as indicated by a dotted line. The belt 30 has a circumferential length greater than a sum of a maximum image size and the pattern area of the optical sensor (including a distance to the trailing edge of an image and a margin of the pattern length). A belt cleaner solenoid, not shown, selectively brings the belt cleaner 34 into and out of contact with the belt 30. Likewise, a lubricant solenoid, not shown, selectively brings the lubricant application unit 32 into and out of contact with the belt 30.

A registration roller 50 and registration sensor 140 are positioned upstream of the sheet transfer charger 33 with respect to the direction of sheet transport. A conveyor belt 51 and a fixing unit 52 are located downstream of the transfer charger 33 with respect to the direction of sheet transport. The registration roller 50 and conveyor belt 51 as well as a fixing roller 53 and a pressure roller 54 are driven by the main motor 110, shown in FIG. 4. Further, the registration roller 50 is turned on and off by the registration clutch 130, shown in FIG. 5.

The fixing device 52 is composed of the fixing roller 53 and the pressure roller 54. The fixing roller 53 and the pressure roller 54 each can contain an internal heat source shown in FIG. 10, as discussed below. Temperature sensors 55 and 56, which may each include a thermistor, are provided near a surface of the fixing roller 53 and the pressure roller 54 to detect respective temperatures thereof.

Figure 6:
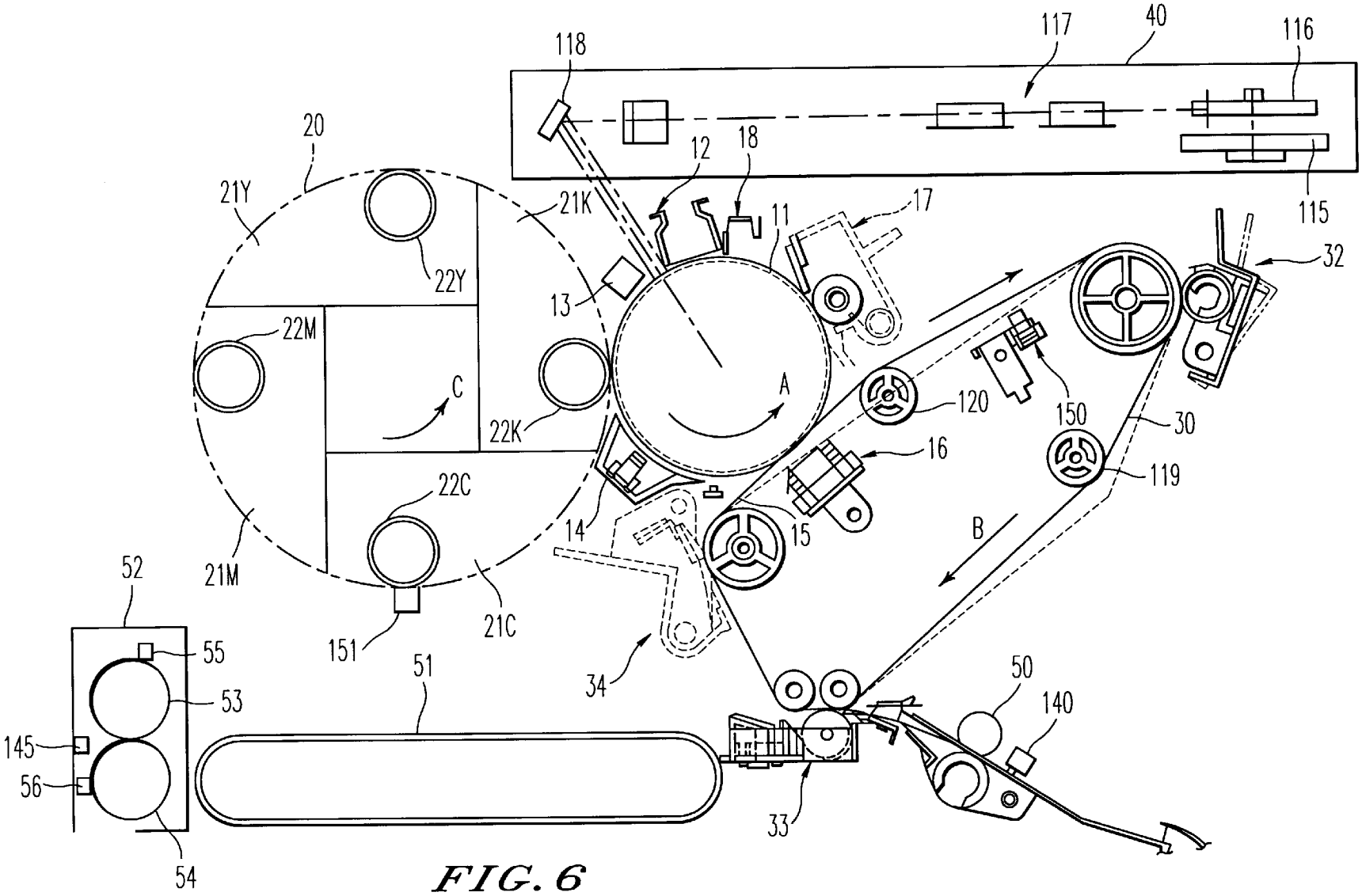
FIG. 6 shows a part of a printer section included in the printer of FIG. 2.

In the construction shown in FIG. 6, the drum 11 rotates in a direction indicated by the arrow A while having its surface uniformly charged by the main CH 12. The writing unit 40 scans the charged surface of the drum 11 in accordance with image data so as to form an electrostatic latent image thereon. The image data will be black image data in the case of a monocolor printing or will be yellow, magenta, cyan and black image data derived from a full-color image in the case of a full-color printing. The latent image formed on the drum 11 is developed by yellow, magenta, cyan or black toner by the revolver 20 to turn out a corresponding toner image.

The toner images of different colors, i.e., yellow, magenta, cyan and black toner images sequentially formed on the drum 11 by the above procedure, are sequentially transferred to the intermediate transfer belt 30 one above the other. The belt 30 rotates in the direction indicated by the arrow B. The resulting composite image or full-color image is transferred from the belt 30 to a sheet by the sheet transfer charger 33. The sheet is fed from a tray, not shown, by a pick-up roller, not shown, via the registration roller 50. The sheet is conveyed by the conveyor belt 51 to the fixing device 52. After the fixing device 52 has fixed the toner image on the sheet, the sheet is then driven out of the copier.

The toner remaining on the drum 11 after the image is transferred therefrom is removed by the drum cleaner 17. Likewise, the toner left on the belt 30 is removed by the belt cleaner 34.

An image forming sequence will now be described with reference to FIGS. 7–9. In the timing charts to be described, any one of the developing sections 21Y–21K may be held at the developing position. "FGATE" appearing in the timing charts refers to an image data gate signal; while the image data gate signal is in its ON state, image data is continuously written to the drum 22. Further, in the following description, the constituent signals shown in the timing charts are indicated by parenthesis below.

First, a monocolor image forming sequence will be described with reference to FIG. 7. FIG. 7 demonstrates a specific case in which two black-and-white printings of size A4 (vertically long) are output.

On receiving a start signal (a) from the system controller 800, the CPU 101, shown in FIG. 4, turns on the QL 18 and drum motor 111 with respective signals (g) and (b). When the start position (discharged portion) of the drum 11 reaches a charging position assigned to the main CH 12, the CPU 101 turns on the main CH 12 (h). Further, when the charged portion of the drum 11 arrives at the developing position, the CPU 101 turns on the DC and AC biases and development motor 112 with respective (i), (j), (k). As soon as the position on the drum 11, where the biases for development have been turned on, arrives at a belt transfer position assigned to the intermediate transfer belt 30, the CPU 101 turns on the belt transfer charger (n). The above procedure is for the case of pre-rotation of the drum 11. If the color of the developing unit held at the developing position is different from a necessary color, then the revolver 20 is rotated after the turn-on of the DC and AC biases until the necessary color has been brought to the developing position.

If the exposing position of the drum 11 has been charged by the pre-rotation process discussed above, then the drum 11 is ready to form a latent image thereon. The CPU 101 transfers a lamp ON signal and a scanner start command (d) to the scanner controller 200, shown in FIG. 4, in order to cause it to output image data after the above timing. When an image is scanned, the resulting image data is transferred from the scanner control section 200 to the write control IC 105, shown in FIG. 4. The write control IC 105 converts the image data to exposure data and controls the LD control unit 106 and motor 115. As a result, a latent image is electrostatically formed on the drum 11 with FGATE (e).

The latent image on the drum 11 is developed by the revolver 20 to turn out a corresponding toner image. The toner image is transferred from the drum 11 to the belt 30 by the transfer charger 16. Before the toner image on the belt 30 arrives at the sheet transfer position, the CPU 101 turns on the sheet transfer charger 33 (o) with the result that the toner image is transferred from the belt 30 to the sheet. Specifically, the sheet is brought to a stop with its leading edge abutting against the registration roller 50, shown in FIG. 6. The registration clutch 130, FIG. 6, is turned on (r) at such a timing that the leading edge of the sheet meets the leading edge of the toner image at the sheet transfer position. The sheet with the toner image is then conveyed to the fixing unit 52 by the conveyor belt 51, shown in FIG. 6.

When the CPU 101 determines that the transfer of the toner image from the belt 30 to the sheet is not followed by any image formation, it turns off the transfer charger 16 (n). Subsequently, the CPU 01 turns off the main CH 12 when the position on the drum 11, where the belt transfer charger 16 has been turned off, arrives at the main CH 12. When such a position on the drum 11 reaches the developing position, the CPU 101 turns off the DC and AC biases for development and the motor 112 with respective (i), (j), (k). At this time, the CPU 101 conditions the mark sensor 150, shown in FIG. 6, for the detection of the reference mark (c). After the mark sensor 150 has sensed the reference mark, the CPU 101 continuously turns on the drum motor 111 (b) until the reference mark has been brought to a preselected position. The CPU 101 turns off the QL 18 (g) at the same time as it turns off the drum motor 111.

After the exposure of the drum 11, the CPU 101 turns on the optical sensor 14 and optical sensor LED, not shown, with respective (f), (1). Also, before turning on the sheet transfer charger 33, the CPU 101 turns on the PTL 15 (m). However, the CPU 101 holds the belt cleaner 34 in contact with the belt 30 (p) and does not turn on the revolver motor 113, FIG. 4, (q).

Figure 7:
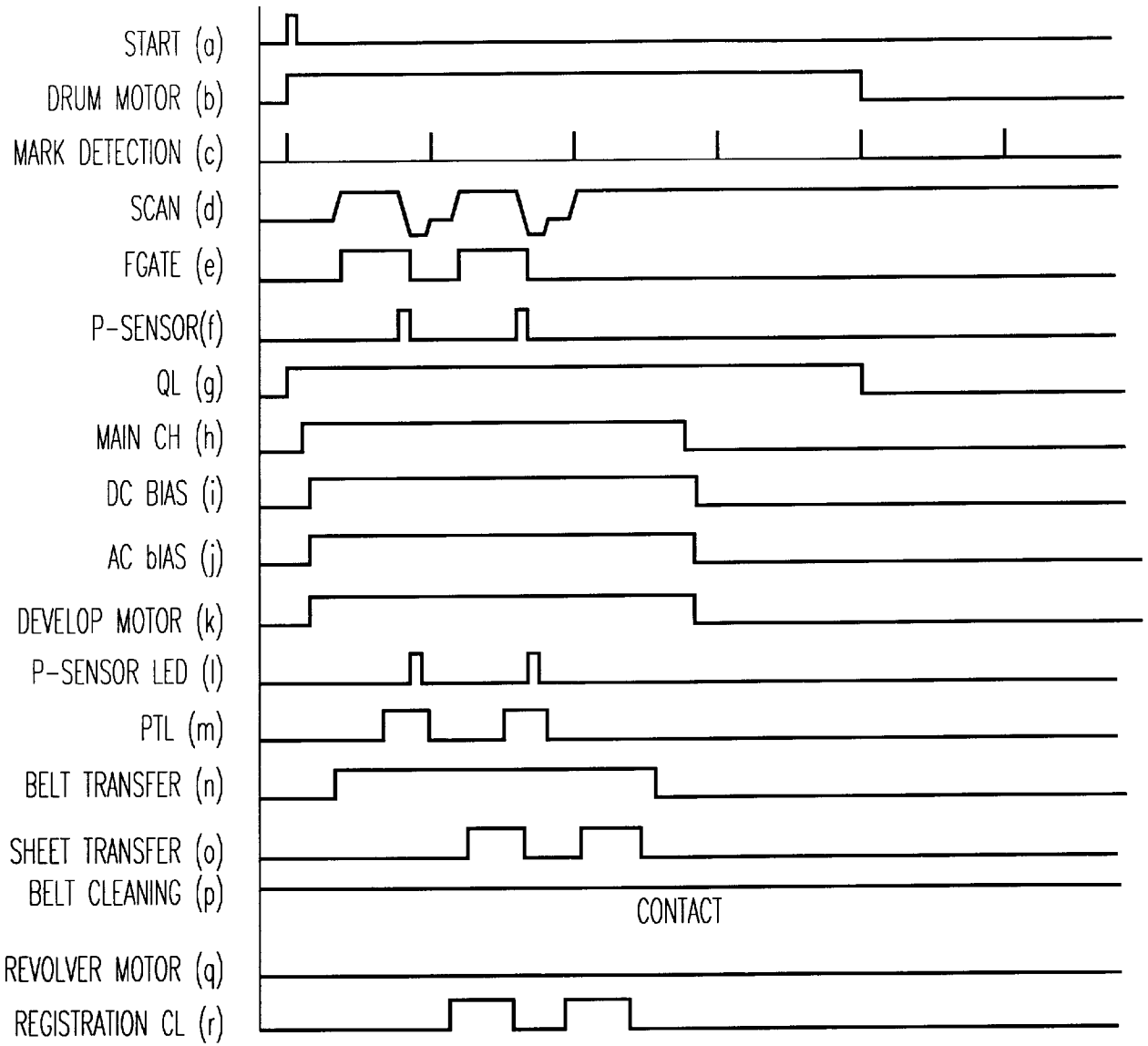
FIG. 7 is a timing chart showing a specific operation in which two black-and-white printings of size A4 are output.
Figure 8:
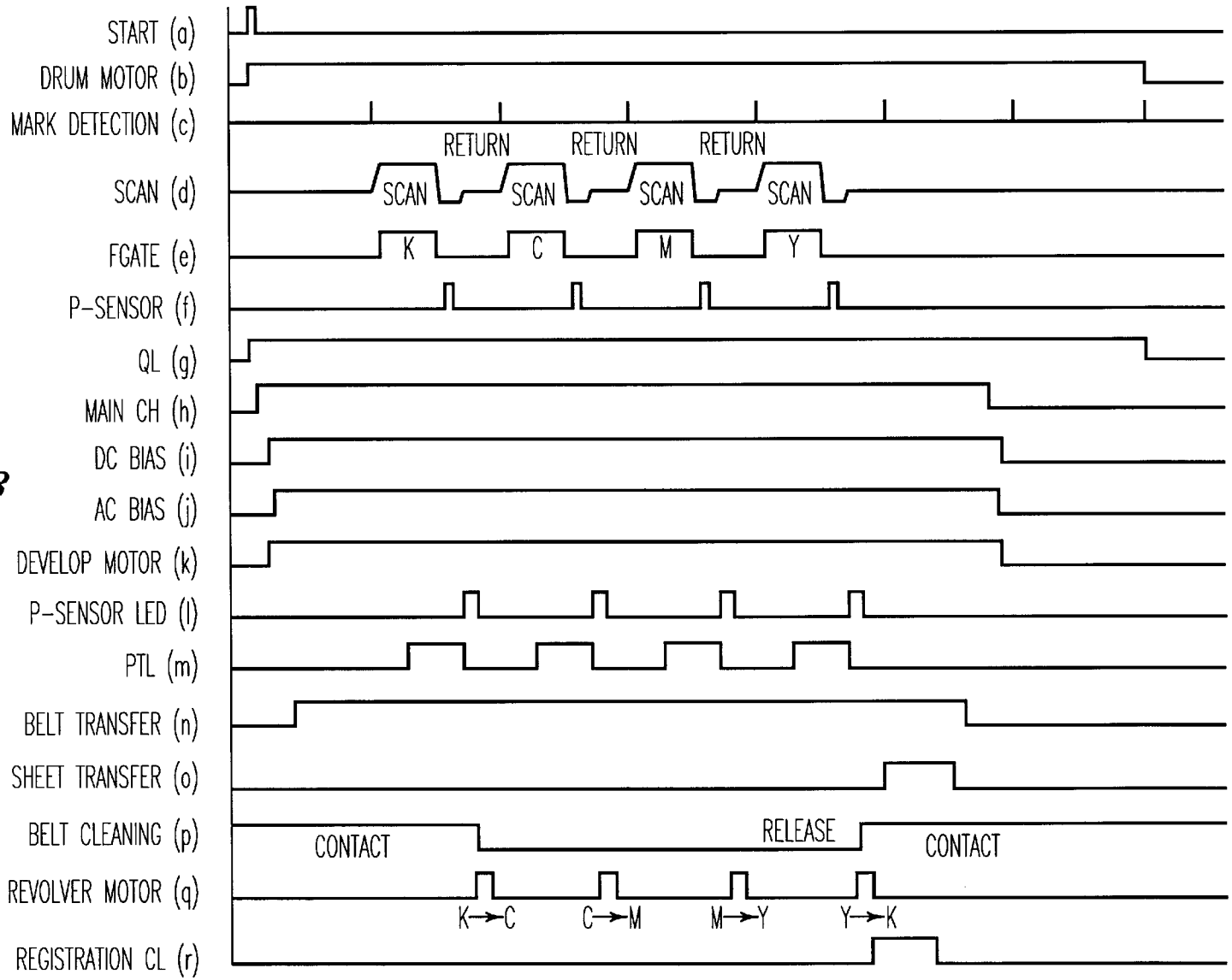
FIG. 8 is a timing chart showing another specific operation in which a single full-color printing of size A4 is output.

FIG. 8 illustrates a timing chart used for a full-color image forming sequence. The part of the sequence identical with that shown in FIG. 7 will not be described in order to avoid redundancy. In the following description, it is assumed that a single full-color printing of size A4 (vertically long) is produced.

The control up to pre-rotation of the drum 11 is the same as in the monocolor printing shown in FIG. 7. In the full-color sequence, the color for development is sequentially switched during image formation. Assume that the drum motor 111 is turned on to rotate the belt 30 until the mark sensor 150 senses the reference mark (c). Then, the CPU 101 executes interrupt processing because the output of the mark sensor 150 is connected to the interrupt terminal of the CPU 101. In the interrupt processing, the CPU 101 sends a scan start command for a first color (K) to the scanner controller 200 (d). After the developing section 21K has developed a latent image of the first color (K) formed on the drum 11, the resulting toner image is transferred to the belt 30. Subsequently, the CPU 101 causes the revolver 20 to rotate (q) until the developing section 21C assigned to a second color (C) has been brought to the developing position. After the transfer of the toner image from the drum 11 to the belt 30, the CPU 101 releases the belt cleaner 34 from the belt 30 (p) so as not to erase the toner image therefrom.

When the mark sensor 150 again senses the reference mark (c), the CPU 101 sends a scan start command for the second color (C) to the scanner controller 200 (d). After a latent image of the second color (C) has been formed on the drum 11, it is developed by the developing section 21C. The resulting toner image is transferred from the drum 11 to the belt 30. Subsequently, the CPU 101 again rotates the revolver (q) until the developing section 21M assigned to a third color (M) reaches the developing position. This is repeated with a third color (M) and a fourth color (Y). As a result, the toner images of different colors are sequentially transferred to the belt 30 one above the other, forming a full-color image. Just before the full-color image arrives at the sheet transfer position, the CPU 101 turns on the sheet transfer charger 33 (o) in order to transfer the full-color image to the sheet. The sheet is then transported in the same manner as in the monocolor printing.

After the transfer of the fourth color (Y) to the belt 30, the CPU 101 causes the revolver 20 to rotate (q) until the developing section 21 K assigned to the first color (K) again reaches the developing position. At the same time, the CPU 101 brings the belt cleaner 34 into contact with the belt 30 (p) in order to clean the surface of the belt 30. As a result, the belt 30 is prepared for a next image formation. The end sequence is the same as in the monocolor printing.

Figure 9:
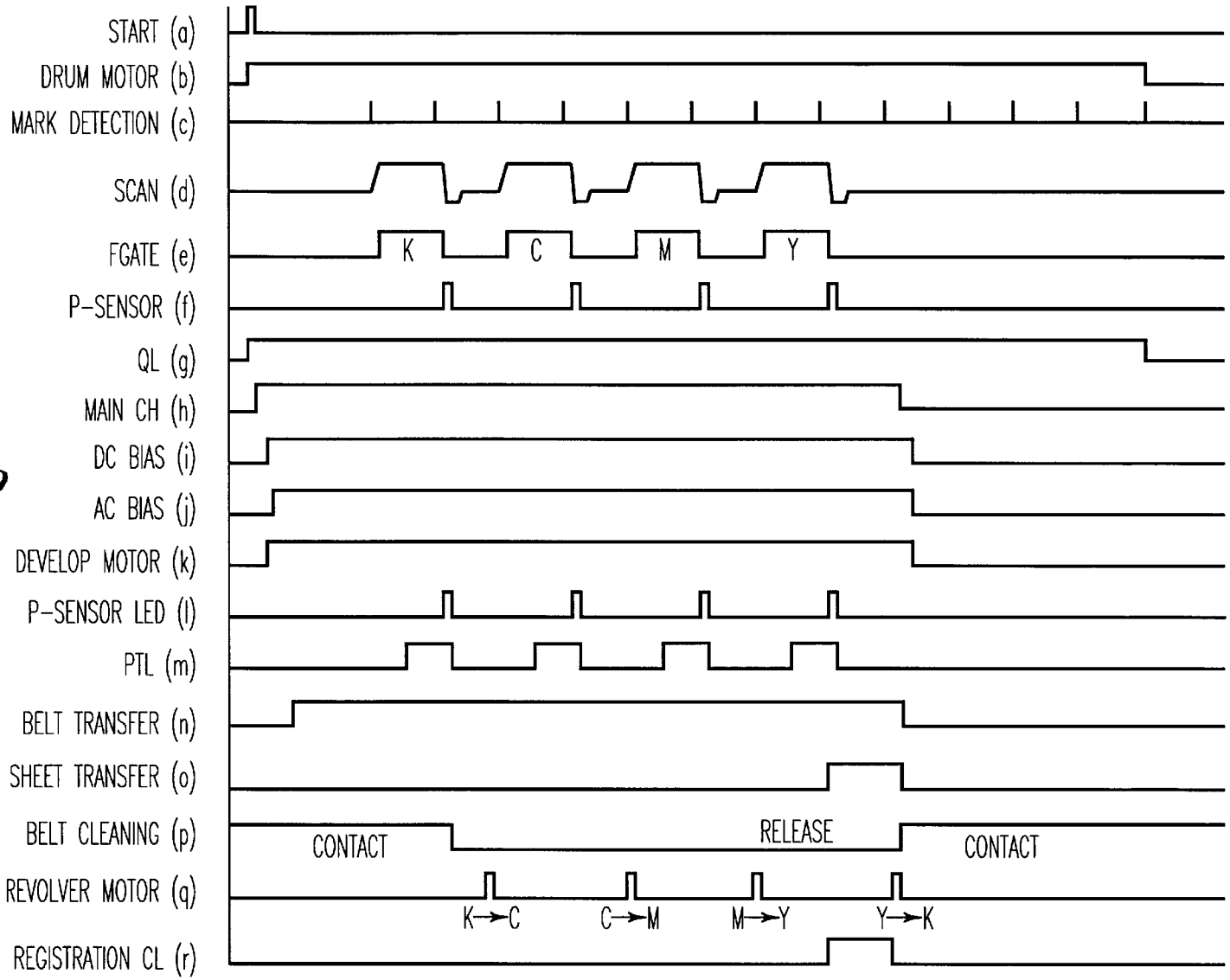
FIG. 9 is a timing chart showing still another specific operation in which a single full-color image of size A3 is output.

FIG. 9 illustrates a timing chart for a single full-color image of size A3 (horizontally long). In FIG. 8, one turn of the belt 30 is the image forming period for a single color. By contrast, in FIG. 9, two turns of the belt 30 is the image forming period for a single color because a time for replacing the color for development is not available with one turn. That is, the detection of the reference mark by the mark sensor 150 is skipped once for each color. The contact of the belt cleaner 34 with the belt 30 and the image transfer to the sheet are effected at a particular timing for each of the sheets of sizes A4 and A3. As for size A4, because the image can be fully accommodated in the distance between the belt transfer charger 16 and the sheet transfer charger 33, the belt cleaner 34 is brought into contact with the belt 30 before the image transfer to the sheet. By contrast, as for the size A3, the belt cleaner 34 is caused to contact the belt 30 before the image is transferred to the sheet because the image cannot be fully accommodated in the above distance and in order to obviate defective image transfer ascribable to vibration.

Assume that an image is input to the printer. Then, the image can be printed on the sheet without sending a scanner start command to the scanner controller 200 and by writing, in a full-color mode, data at the timing based on the output of the mark sensor 150.

A description of FIGS. 10–15 will now be given to further clarify the fixing process performed by the fixing unit 52 in FIG. 6.

Figure 10:
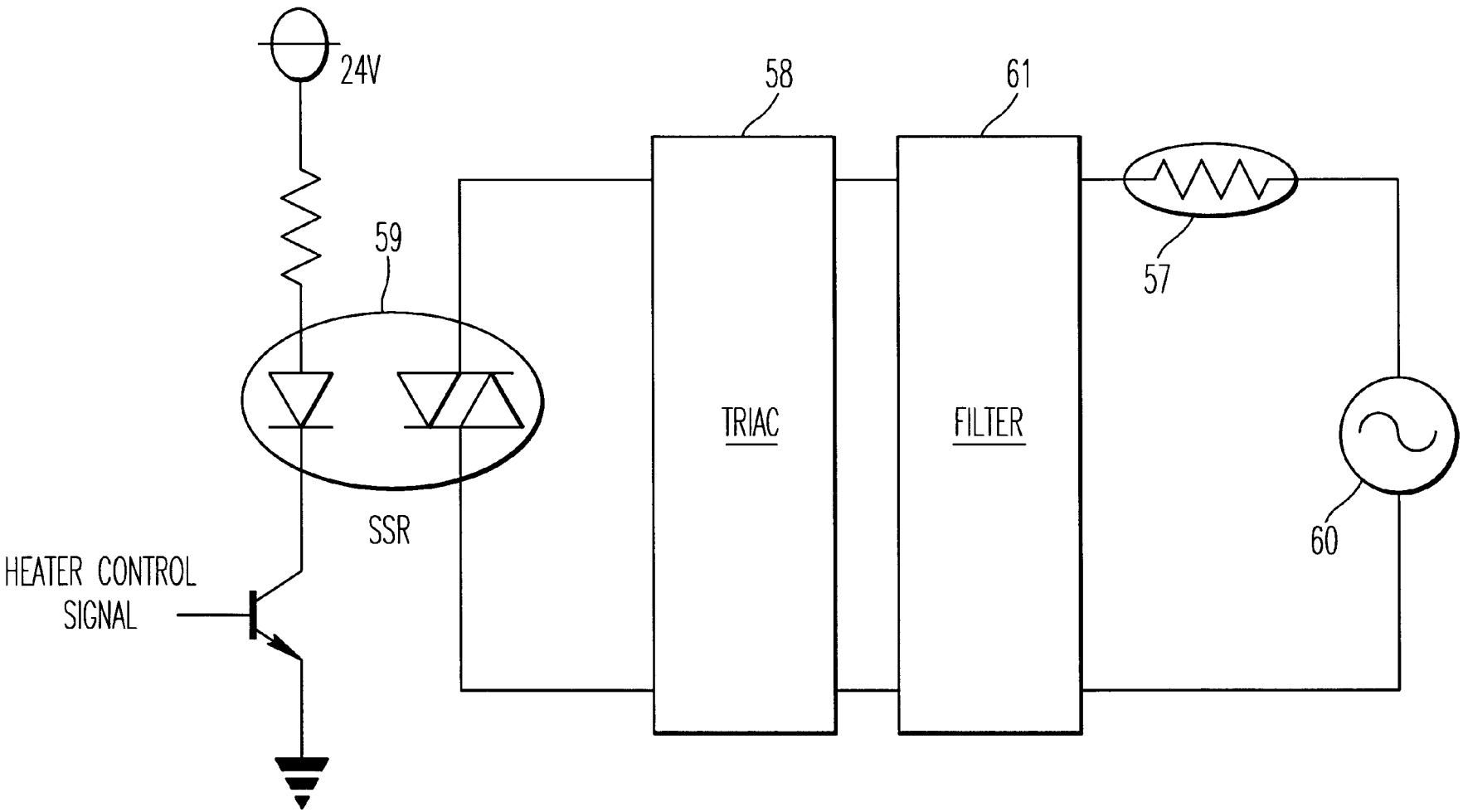
FIG. 10 is an illustration of a device used to heat a fixing roller or pressure roller.

FIG. 10 illustrates a heater device used to heat the fixing roller 53 or pressure roller 54. This device includes a heater 57 connected to a power source 60 through a triac 58. A set/reset switch circuit 59, for example a solid state relay, is connected to the CPU 101, shown in FIG. 4, and the triac 58. When the set/reset switch circuit 59 is ON in response to a heater control signal instruction from the CPU 101, the heater 57 is connected to the power source 60 through the triac to supply power to the heater 57. The CPU 101 thereby controls the on/off status of the heater through the heater control signal controlling set/reset switch 59. A filter 61 is further provided to filter signals between the power source 60, heater 57, and triac 58.

Figure 11:
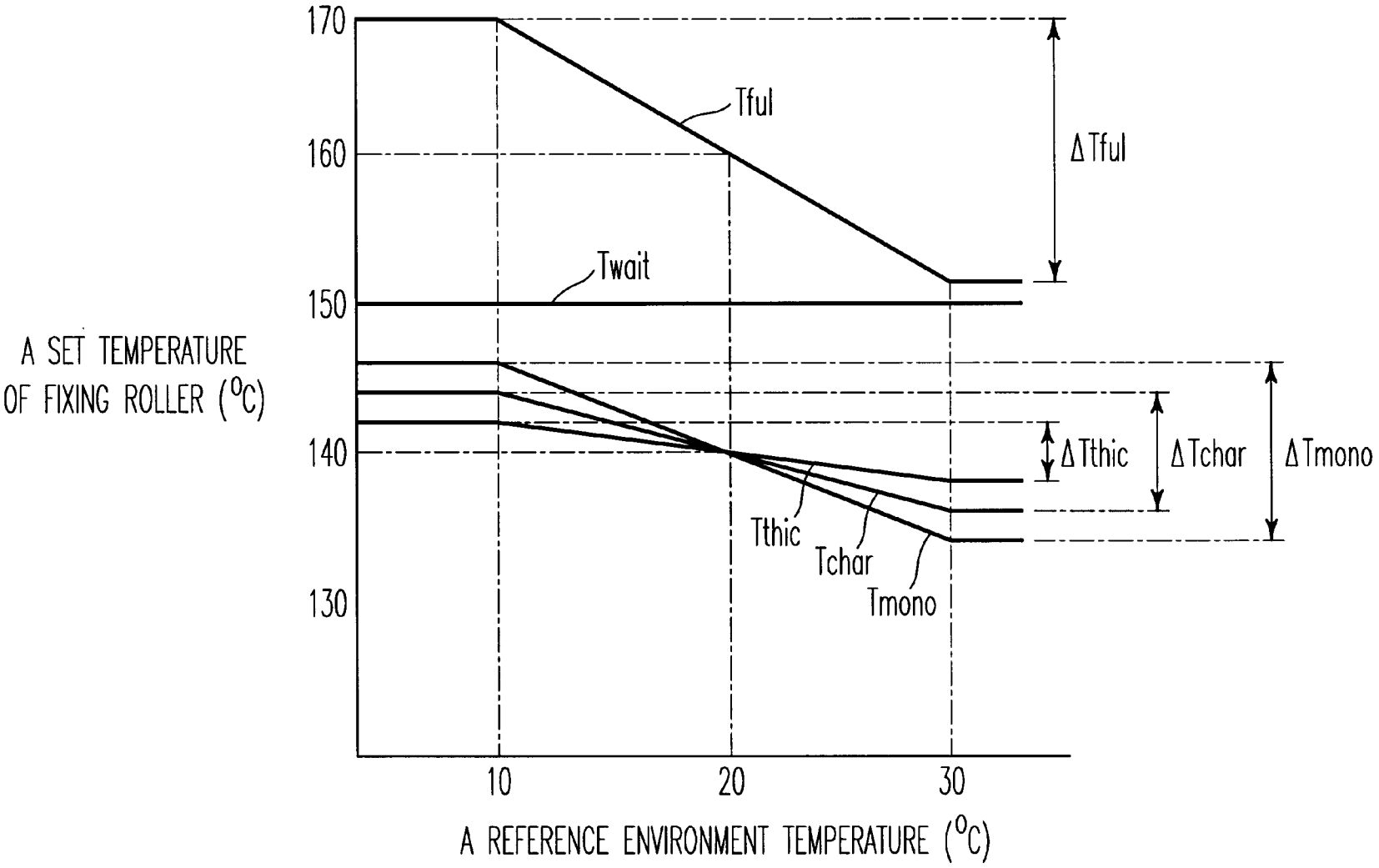
FIG. 11 is a graph showing a set temperature of a fixing roller versus a reference environment temperature according to a first embodiment of the present invention.

FIG. 11 is a graph illustrating how to set a temperature of the fixing roller 53 based on a reference environment temperature and an operating mode, according to an embodiment of the present invention. The reference environment temperature is detected by a sensor or the like (not shown).

As shown in the FIG. 11, the slope of the lines Tthic, Tchar, and Tmono are different than the slope of the line Tful. The line Tful shows a relationship between the reference environment temperature and the set temperature for a full color mode copy operation, the line Tmono shows the same relationship for a monochromatic mode, the line Tchar shows the same relationship for a character mode, the line Tthic shows the same relationship for a thick paper mode, and the line Twait shows the same relationship during a standby state. As can be seen in the FIG. 11, for an ambient temperature of 20° C., the set temperatures are as follows:

- the set temperature of the fixing roller 53 for the full color mode: 160° C.;
- the set temperature of the fixing roller 53 for the monochromatic mode: 140° C.;
- the set temperature of the fixing roller 53 for the thick paper mode: 140° C.;
- the set temperature of the pressure roller 54: 150° C.; and
- the set temperature of the fixing roller 53 during a standby state: 150° C.

The above temperatures are approximated and provided as examples and other temperatures may be used.

Since the fixing roller 53 and pressure roller 54 are adjacent to each other, the set temperature of the pressure roller 54 is set to 150° C. in order to reduce the amount of heat absorbed from the fixing roller 53 for a full color mode. Further, as shown in FIG. 11, the difference between the maximum and minimum temperatures for the full color mode (ΔTful) is greater than for any of the other modes (ΔTthic, ΔTchar, and ΔTmono). In addition, as shown in FIG. 11, for a reference temperature of 20° C. the temperature difference, i.e. temperature gradient, between the full color mode and the monochromatic would be 20° C. (i.e. 160° C. for the full color made—140° C. for the monochromatic mode). The set temperature during a standby state is 150° C. which is in the middle of the full color mode and the other modes for a reference temperature of 20° C.

The temperature gradient difference between the maximum and minimum temperatures for each of the other modes could be set as follows:

ΔTful (full color mode) is 16°;

ΔTmono (monochromatic mode) is 12°;

ΔTchar (character mode) is 8°; and

ΔTthic (thick paper mode) is 4°.

Therefore the following relationship shown in FIG. 11 can be stated as:

$$\Delta Tful > \Delta Tmono > \Delta Tchar > \Delta Tthic \quad (a)$$

As previously discussed, the slope of the line Tful is different than the slope of the other lines (Tmono, Tchar, and Tthic). Therefore, the set temperature of the fixing roller 53 for a copying mode other than that for the full color mode has a smaller change in temperature for a change in the environment temperature than that of the full color mode. Consequently, when the reference environment is relatively low, e.g., below 20° C., the set temperature for the full color mode is changed by a larger degree to obtain a sufficient amount of heat to prevent improper fixing. On the other hand, when a reference temperature is relatively low, the set temperature in, for example, the monochromatic mode is changed by a smaller degree. To the contrary, in the background device shown in FIG. 1, the set temperature of the fixing roller for the monochromatic mode is changed to the same degree as that for a full color mode. The inventors of the present application have recognized that is important to have a smaller change in temperature for a non-full color mode copy operation in order to prevent improper fixing.

Further, the temperature differences ΔTmono, ΔTchar, and ΔTthic, may be set equal to each other. Therefore, the slope of the lines ΔTmono, ΔTchar, and ΔTthic shown in FIG. 11 would be the same. In this case, the following relationship may be obtained:

$$\Delta Tful > \Delta Tmono = \Delta Tchar = \Delta Tthic \quad (b)$$

Similarly, ΔTmono and ΔTchar may be set equal to each other. In this case the following relationship may be obtained:

$$\Delta Tful > \Delta Tmono = \Delta Tchar > \Delta Tthic \quad (c)$$

Further, ΔTchar and ΔThic may be set equal to each other, resulting in the following relationship:

$$\Delta Tful > \Delta Tmono > \Delta Tchar = \Delta Tthic \quad (d)$$

By combining the above equations (a, b, c, d), the following equation can be obtained:

$$\Delta Tful \geqq \Delta Tmono \geqq \Delta Tchar \geqq \Delta Tthic \quad (e)$$

A description of how the set temperature is controlled when an auto-color/monochrome select mode and/or an auto-character/picture mode is selected will now be given.

When an auto-color/monochrome mode is selected, it is automatically determined whether a scanned document is a color document or a monochromatic document. Likewise, when the auto-character/picture mode is selected, it is automatically determined whether or not a scanned document has only characters. When the auto modes are not used, the document is scanned after a user selects the appropriate document type (e.g., monochromatic, thick paper, etc.). In this case, there is usually enough time for the fixing roller to reach a set temperature before the document is scanned. However, when an auto mode is selected there may not be enough time for the temperature of the fixing roller to reach a set temperature before a paper has reached the fixing apparatus. This is because the type of document (e.g., monochromatic, color, etc.) is determined after the document has been scanned.

Figure 12:
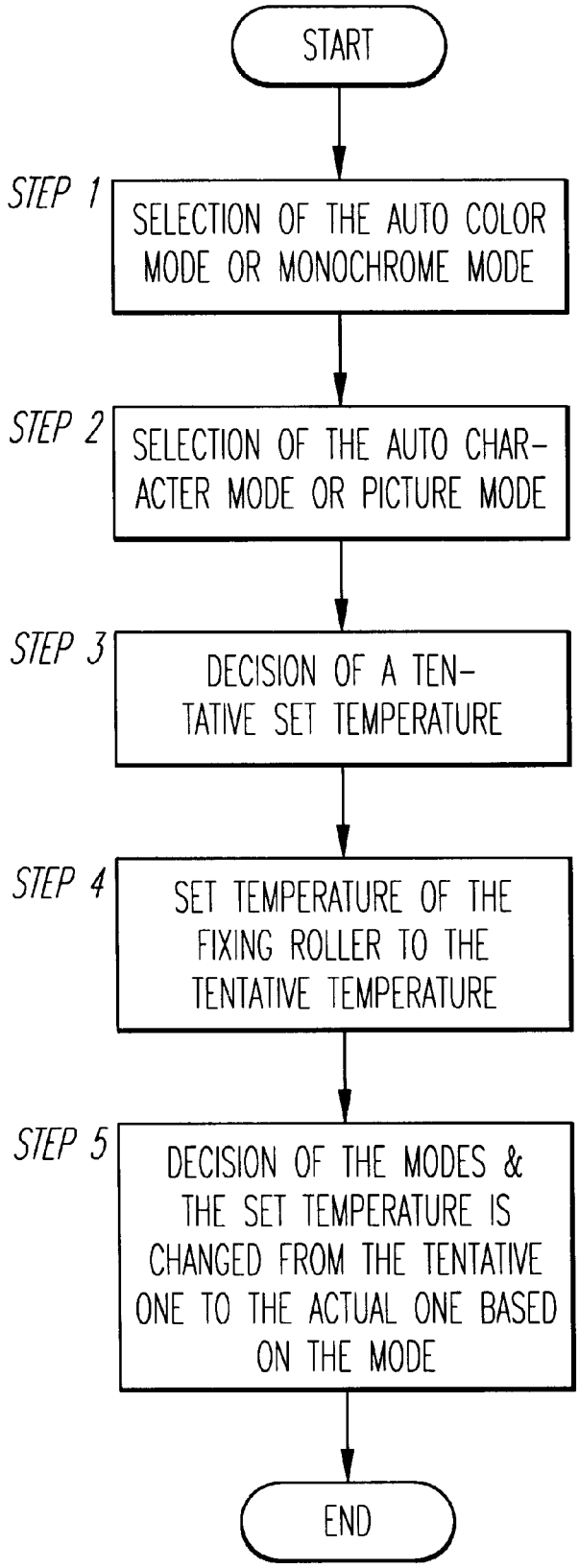
FIG. 12 is a flowchart illustrating a process of determining the set temperature for a fixing roller if an auto color/monochromatic and/or an auto character/picture mode is selected.

FIG. 12 illustrates a process of how the set temperature of the fixing roller 53 is determined for the case when the auto modes discussed above are selected. When the auto-color/monochrome select mode and/or the auto-character/picture mode is selected (step 1 and step 2, respectively), a highest set temperature of the fixing roller 53 is decided as a tentative set temperature (step 3). The temperature of the fixing roller 53 is changed and controlled according to this tentative temperature (step 4). When the first document has been scanned by the scanner 2 (FIG. 3) and the mode has been determined automatically, the set temperature of the fixing roller 53 is changed from the tentative temperature to the actual temperature determined from the graph shown in, for example, FIG. 11. For the case discussed above, when the auto-color/monochrome mode and the auto-character/picture is selected, the tentative temperature would be the highest set temperature shown in FIG. 11, i.e., 170° C. for the full color mode. Then the fixing roller 53 is set to this temperature. After the type of the first document is determined, the temperature of the fixing roller 53 is appropriately adjusted to a temperature found from using, for example, the relationships shown in FIG. 11.

Figure 13:
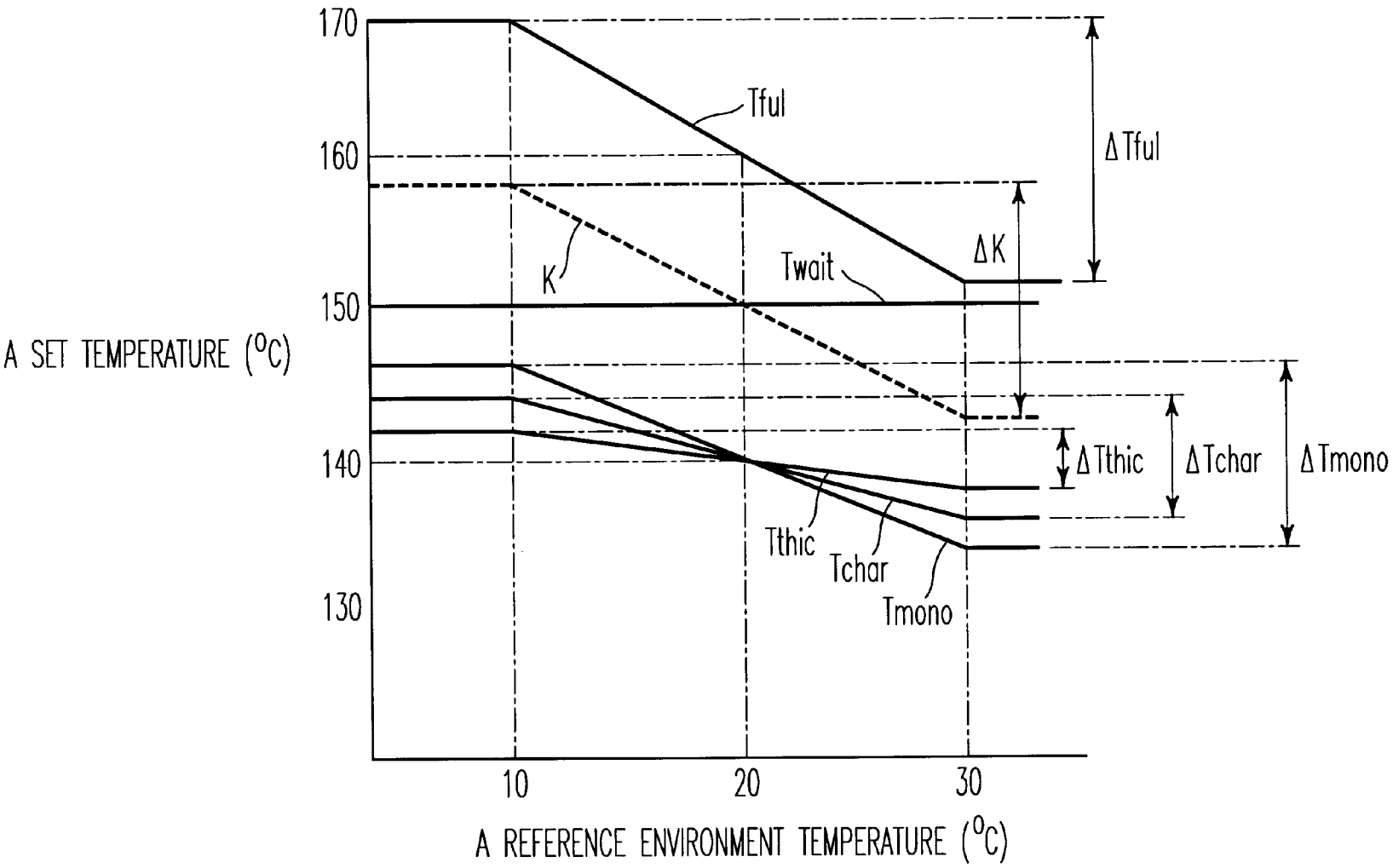
FIG. 13 is a graph showing a set temperature of a fixing roller and/or a pressure roller versus a reference environment temperature according to a second embodiment of the present invention.

FIG. 13 illustrates a diagram showing relationships between a reference environment temperature and a set temperature of the fixing roller 53 and the pressure roller 54 for a further embodiment of the present invention. In this embodiment, the set temperature of the pressure roller 54 is not maintained at 150° C., but is changed according to the line K shown in FIG. 13. The line K shows the relationship between the reference temperature and the set temperature of the pressure roller 54. For example, when the reference environment temperature is 20° C. (ambient temperature), the set temperature of the pressure roller is 150° C. However, as shown in FIG. 13, as the reference temperature increases, the set temperature of the pressure roller decreases and vice-versa. A temperature difference between the highest and lowest set temperature for the pressure roller 54 is shown as ΔK. Note, that ΔK is not the same as the temperature differences for the fixing roller (ΔTful, ΔTmono, ΔTchar, ΔTthic). In other words, the slope of the line K is different from the slope of the lines Tful, Tthic, Tchar, and Tmono. According to this embodiment, a proper fixing temperature based on the environmental temperature can be obtained for both the pressure roller 54 and the fixing roller 53 and an excellent fixing quality can be achieved.

Figure 14:
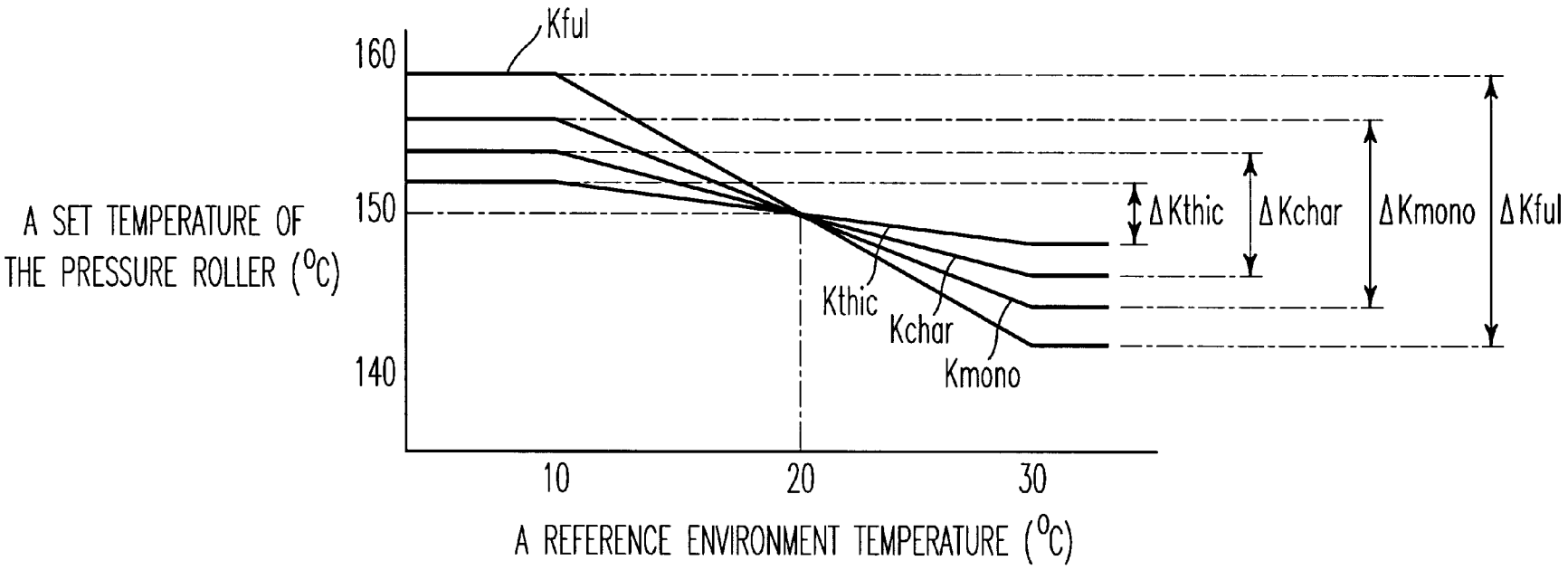
FIG. 14 is a graph showing a set temperature of a pressure roller versus a reference environment temperature according to a third embodiment of the present invention.

FIG. 14 illustrates a diagram showing relationships between a reference environment temperature and a set temperature for the pressure roller 54 in a further embodiment of the present invention.

In this embodiment of FIG. 14, the set temperature of the pressure roller 54 is different for each of modes (Kful, Kthic, Kchar, and Kmono). The line Kful designates the reference environment temperature verses the set temperature of the pressure roller 54 for the full color mode, the line Kmono designates the same relationship for the monochromatic mode, the line Kchar designates the same relationship for the character mode, and the line Kthic designates the same relationship for the thick paper mode. The differences between the maximum and minimum temperature of the pressure roller for each case (i.e, ΔKthic, ΔKchar, ΔKmono, and ΔKful) is equal to the respective temperature difference for the fixing roller 53. That is, ΔKful=ΔTful, ΔKmono=ΔTmono, ΔKchar=ΔTchar, ΔKthic=ΔTthic. In this embodiment, an excellent fixing quality can be obtained by setting the temperature of the pressure roller 54 in accordance with FIG. 14.

FIGS. 15–19 are diagrams used to describe an operation in a case in which the environment temperature sensor is not functioning properly.

Figure 16:
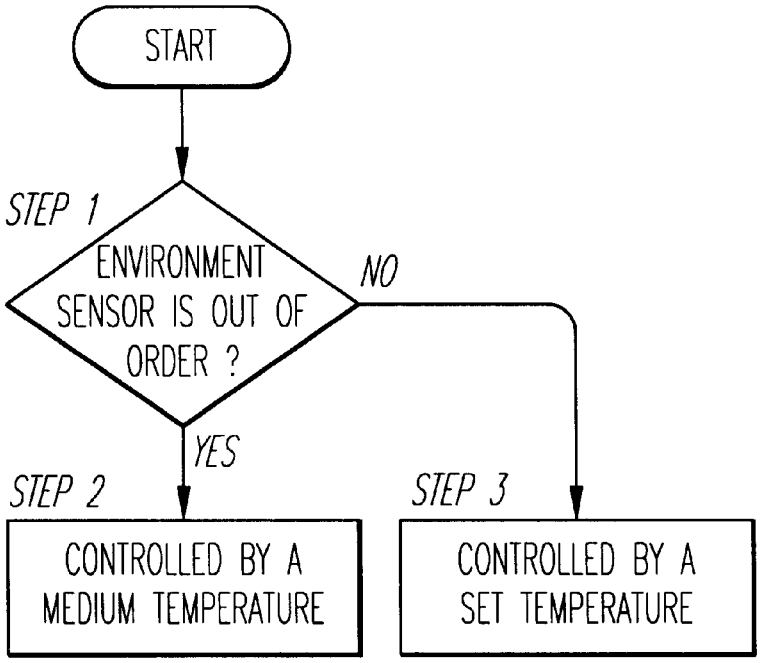
FIG. 16 is a flowchart illustrating a process used to determine a fixing roller temperature when an environment temperature sensor is not working properly.

FIG. 16 shows a process of addressing a situation in which an environment temperature sensor is out of order. In FIG. 16, when it is determined that an environment temperature sensor is out of order (Yes in step 1), the temperature of the fixing roller 53 is set to a temperature which is between a maximum and a minimum set temperatures (i.e., a medium temperature) (step 2). If it is determined that the environment temperature sensor is not out of order (i.e., is working properly) (No in step 1), the temperatures of the fixing roller 53 and pressure roller 54 are set according to any one of the above embodiments. The CPU 101, FIG. 4, is able to determine that the sensor is not functioning properly or is out of order when, for example, there is no signal from the sensor, the output signal is beyond a predetermined level, etc.

Figure 15:
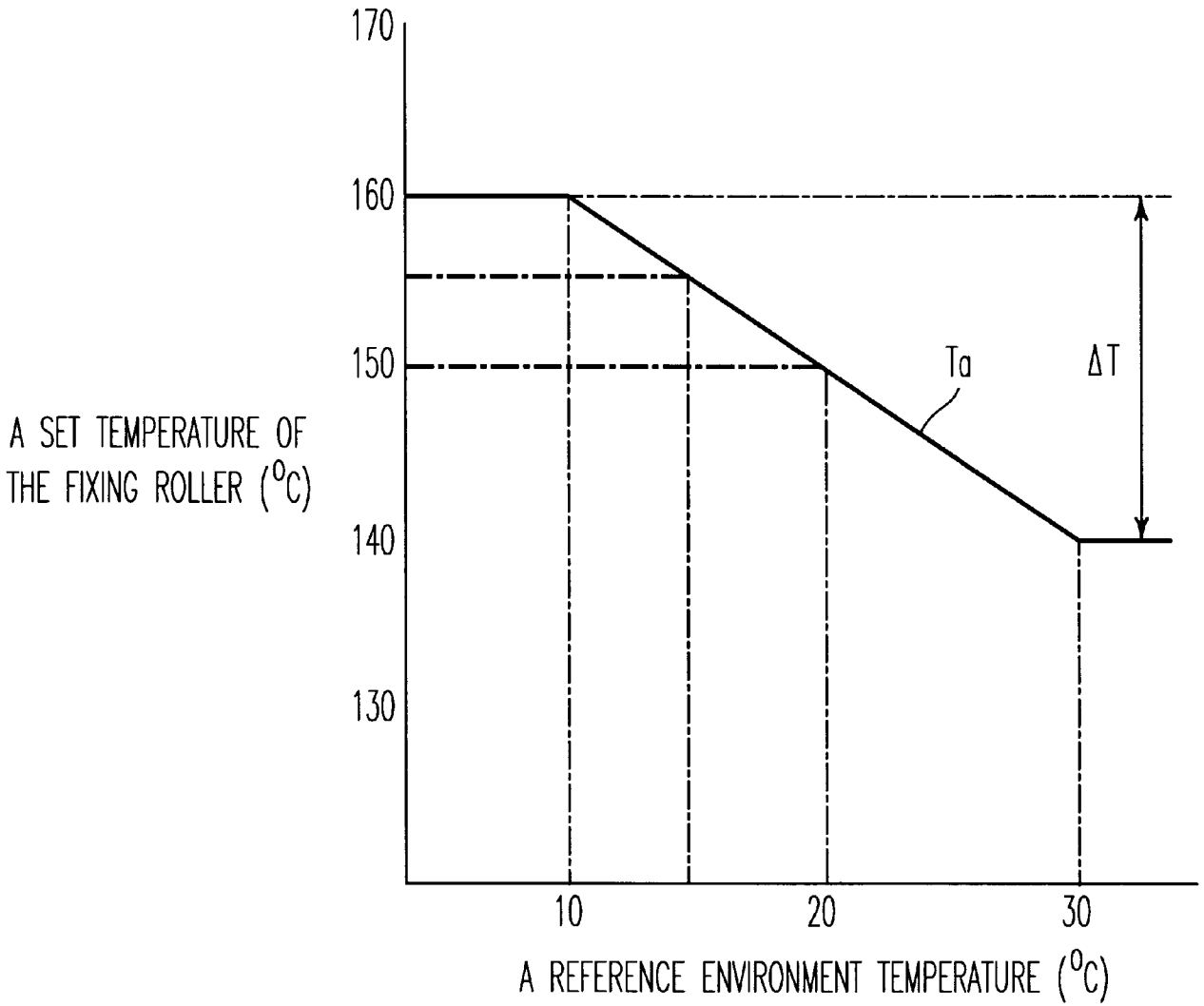
FIG. 15 is a graph illustrating a set temperature of a fixing roller versus a reference environment temperature for a case when an environment temperature sensor is not working properly.

In FIG. 15, a line Ta shows a relationship between a reference environment temperature and a set temperature for the fixing roller 53. In addition, in FIG. 15, a temperature difference ΔT between the maximum and minimum temperatures equals 20° C. The medium temperature shown in FIG. 15 is 150° C. and the fixing roller 53 would be set to this value if the environment sensor malfunctioned. According to this embodiment, when the sensor is out of order, improper fixing can be prevented by setting the temperature of the fixing roller to a medium temperature, rather than a high or low temperature. Further, the image forming apparatus can continue operation as it is not necessary to halt the copy operation when the sensor is out of order. The above medium temperature of 150° C. is an example only and other temperatures could be selected as the medium temperature.

Figure 17:
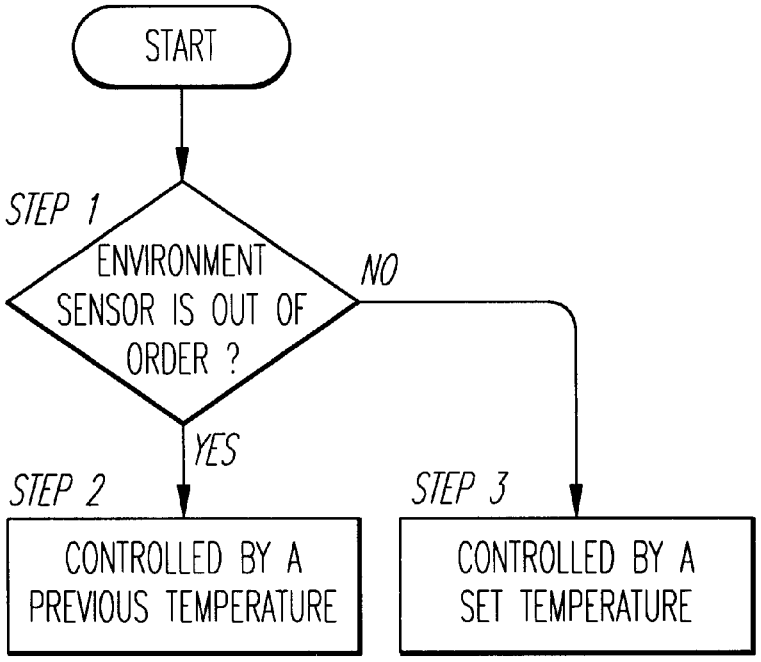
FIG. 17 is a flowchart illustrating another process used to determine a fixing roller temperature when an environment temperature sensor is not working properly.

FIG. 17 is a flow chart illustrating another process of addressing the situation when it is determined the environment sensor is out of order (Yes in step 1). In this operation of FIG. 17, if the environment sensor is out of order, then the temperature of the fixing roller 53 will be set to a previous temperature (see step 2). The previous temperature of the fixing roller 53 can be determined from the reference environment temperature just before the sensor malfunctioned. The environment temperature can be stored in a memory device, such as RAM 103 shown in FIG. 4. When it is determined that the environment sensor is not out of order (No in step 1), the temperature of the fixing roller 53 is set in accordance with any one of the previous embodiments.

Figure 18:
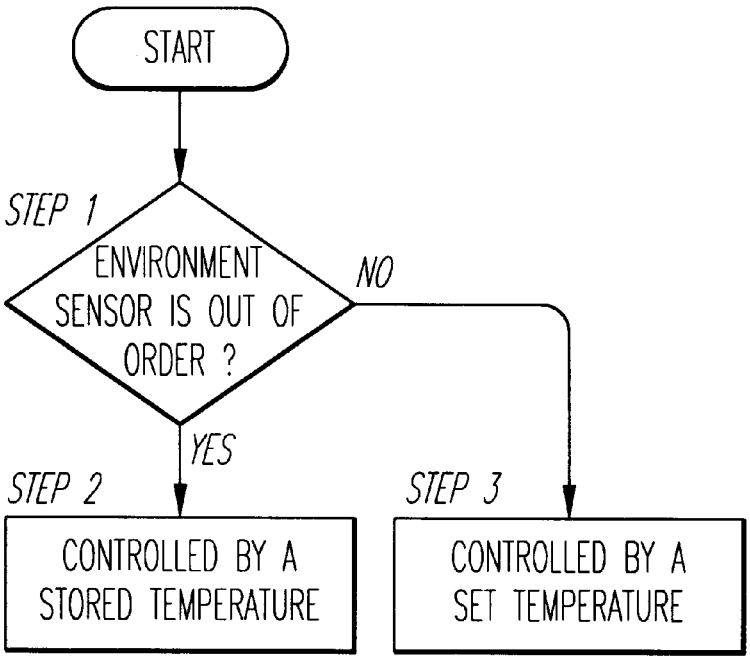
FIG. 18 is a flowchart illustrating yet another process used to determine a fixing roller temperature when an environment sensor is not working properly.

In FIG. 18 if the environmental sensor is determined to be out of order (Yes in step 1), then the temperature of the fixing roller 53 is set to a stored temperature based on a time when the sensor malfunctioned (step 2). The environment temperature and time of day may be stored in a memory, such as the RAM 103 shown in FIG. 4. For example, if it was 10:20 A.M. when the environment sensor malfunctioned, the temperature of the fixing roller 53 can be set according to the temperature of the fixing roller 53 at, for example, 10:20 A.M. the day before. If it is determined that the environment sensor is not out of order (No in step 1), then the temperature of the fixing roller 53 is controlled by the set temperature according to any one of the above embodiments.

Figure 19:
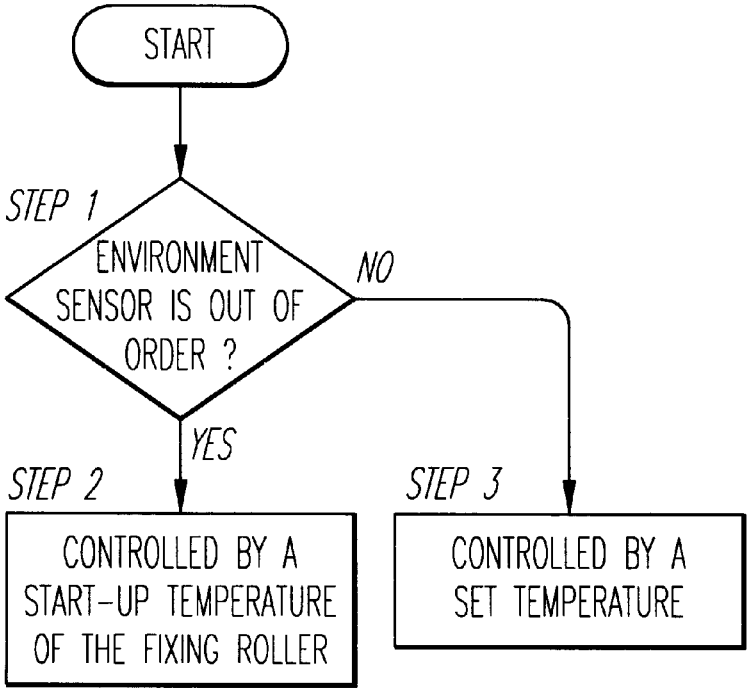
FIG. 19 is a flowchart illustrating still yet another process used to determine a fixing roller temperature when an environment sensor is not working properly.

In FIG. 19, when the environmental sensor is determined to be out of order, (Yes in step 1), the temperature of the fixing roller 53 is set to a start-up temperature which may be stored in a memory device, such as the RAM 103 shown in FIG. 4. In addition, a start-up temperature of the pressure roller 54 may also be used as the set temperature for the fixing roller 53.

Figure 20:
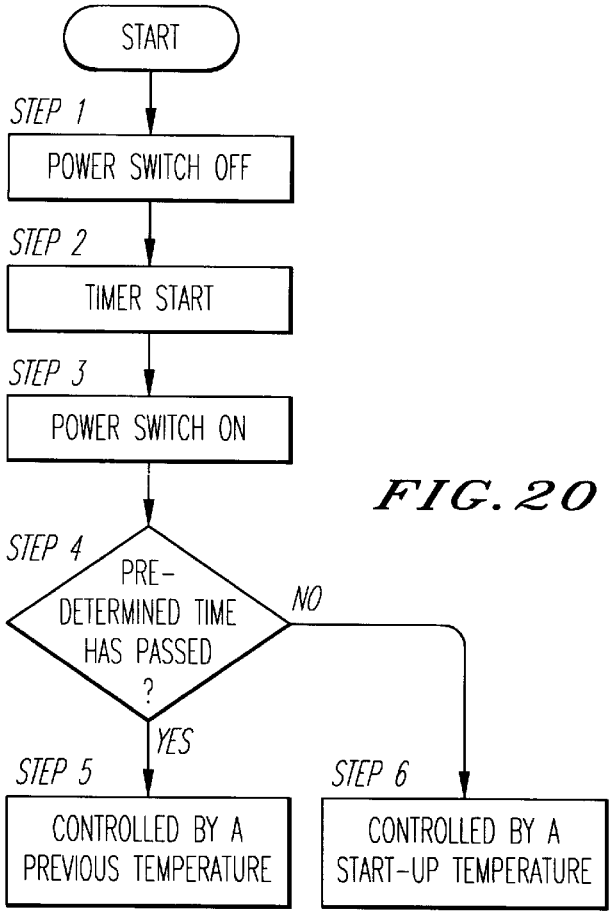
FIG. 20 is a flowchart illustrating a process of how a temperature of a fixing roller is controlled when a copy machine is turned off.
Figure 21:
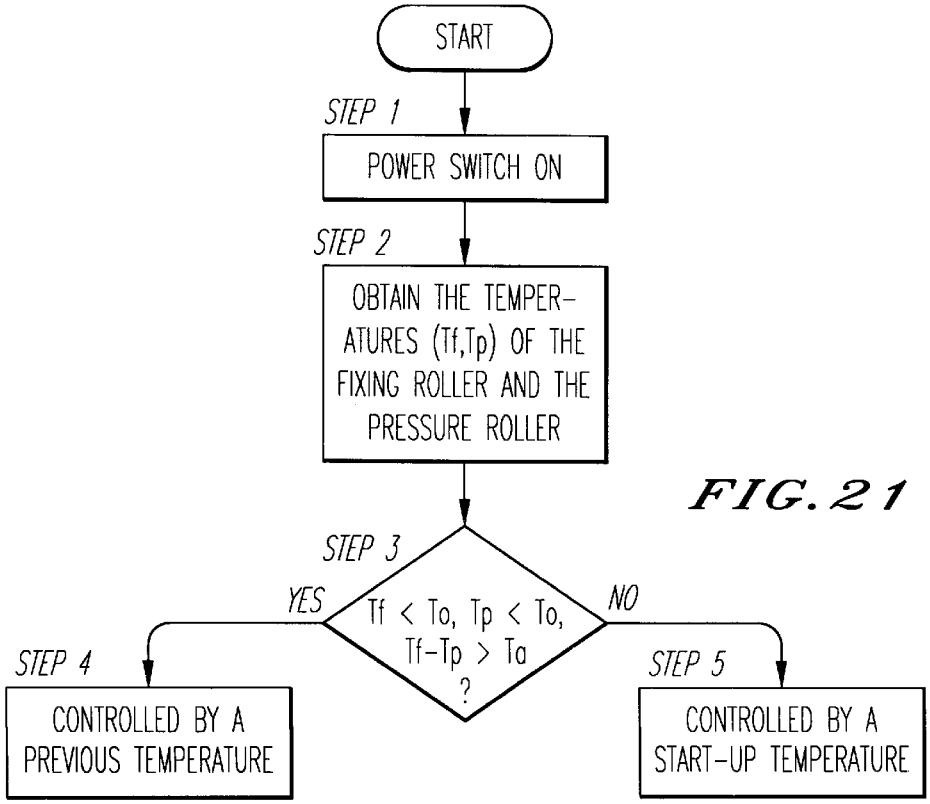
FIG. 21 is a flowchart illustrating yet another process of controlling a temperature of a fixing roller when a copy machine is turned off.

FIGS. 20 and 21 describe an embodiment of the invention on how to control the temperature of the fixing roller 53 when the power switch to the copy machine is turned off. As shown in FIG. 20, when the power switch is turned off (step 1), a timer is started (step 2). After the power switch is turned on (step 3), a determination is made whether a time counted by the timer in step 2 is greater than a predetermined timed (e.g., 5 minutes) (step 4). If the predetermined time has not passed (No in step 4) then the fixing roller 53 temperature is controlled by a start up temperature (step 6). If the predetermined time has passed (Yes in step 4), then the fixing roller 53 temperature is set and controlled based on a previous environment temperature stored in, for example, the RAM 103.

Instead of using the timer discussed above, a surface temperature of the fixing roller 53 and pressure roller 54 can be obtained and stored in a memory, such as the RAM 103 shown in FIG. 4. In this case, just after the power switch is turned off, the surface temperatures of the fixing roller 53 and the pressure roller 54 are still high. As time progresses these temperatures will begin to decrease, with the pressure roller 54 temperature decreasing faster than that of the fixing roller 53 temperature because the roller materials are different.

FIG. 21 shows yet another process of how to control the temperature of the fixing roller 53 when the copy machine is turned on. When the copy machine is turned on (step 1), the temperatures Tf and Tp of the fixing roller 53 and pressure roller 54, respectively, are obtained (step 2). If the temperatures Tf and Tp are lower than a predetermined temperature To and the difference between the temperatures Tf and Tp is larger than another predetermined temperature Ta, (e.g., 5°), (i.e., Yes in step 3), then the set temperature of the fixing roller 53 is set to the previous temperature of the fixing roller 53 based on the previous reference environment temperature (step 4). If the answer is No in step 3, the set temperature of the fixing roller 53 is set to the start up temperature of the fixing roller 53 (step 5).

Obviously, numerous additional modifications and variations of the present invention are possible in light of the above teachings. It is therefore to be understood that within the scope of the appended claims, the invention may be practiced otherwise than as specifically described herein.

This application is based on Japanese Priority Documents 08-191173 and 08-191172, the contents of which are incorporated herein by reference.

What is claimed as new and desired to be secured by Letters Patent of the United States is:

1. Am image forming apparatus, comprising:

a fixing roller;

a pressure roller facing the fixing roller; and a controller controlling a temperature of the fixing roller in accordance with a fist temperature gradient relationship of sensed environment temperature in a first operation mode of the image forming apparatus, controlling said temperature of the fixing roller in accordance with a second temperature gradient relationship, different than the first temperature gradient relationship, of the sensed environment temperature in a second operation mode different than the first operation mode, and controlling said temperature of the fixing roller within a predetermined range in accordance with a set temperature, wherein a set temperature in the first operation mode of the image forming apparatus is determined based on the sensed environment temperature and the first gradient temperature, and a set temperature in the second operation mode of the image forming apparatus is determined based on said sensed environment temperature and the second temperature gradient relationship different from said first temperature gradient.

2. The image forming apparatus according to claim 1, wherein the first operation mode is a full-color image forming operation mode and the second operation mode is a non-full color image forming operation mode.

3. The image forming apparatus according to claim 1, wherein the controller further controls the temperature of the fixing roller in accordance with a third temperature gradient relationship of the sensed temperature in a third operation mode.

4. The image forming apparatus according to claim 3, wherein the controller further controls the temperature of the fixing roller in accordance with a fourth temperature gradient relationship of the sensed temperature in a fourth operation mode.

5. The image forming apparatus according to claim 4, wherein the fourth operation mode is a thick paper image forming mode.

6. The image forming apparatus according to claim 1, wherein the controller further controls a temperature of the pressure roller in accordance with a third temperature gradient relationship of the sensed environment temperature.

7. The image forming apparatus according to claim 1, wherein the controller further controls a temperature of the pressure roller in accordance with a third temperature gradient relationship of the sensed environment temperature in the first operation mode and further controls the temperature of the pressure roller in accordance with a fourth temperature gradient relationship, different than the third temperature gradient relationship, of the sensed environment temperature in the second operation mode.

8. The image forming apparatus according to claim 7, wherein the first operation mode is a full-color image forming operation mode and the second operation mode is a non-full color image forming operation mode.

9. The image forming apparatus according to claim 7, wherein the controller further controls the temperature of the pressure roller in accordance with a fifth temperature gradient relationship of the sensed temperature in a third operation mode.

10. The image forming apparatus according to claim 9, wherein the controller further controls the temperature of the pressure roller in accordance with a sixth temperature gradient relationship of the sensed temperature in a fourth operation mode.

11. The image forming apparatus according to claim 10, wherein the fourth operation mode is a thick paper image forming mode.

12. An image forming apparatus, comprising:

means for fixing an image on a recording medium, and including a fixing means and a pressure means; and control means for controlling a temperature of the fixing means in accordance with a first temperature gradient relationship of a sensed environment temperature in a first operation mode of the image forming apparatus and controlling said temperature of the fixing means in accordance with a second temperature gradient relationship, different than the first temperature gradient relationship, of the sensed environment temperature in a second operation mode different than the first operation mode.

13. The image forming apparatus according to claim 12, wherein the first operation mode is a full-color image forming operation mode and the second operation mode is a non-full color image forming operation mode.

14. The image forming apparatus according to claim 12, wherein the controller further controls the temperature of the fixing means in accordance with a third temperature gradient relationship of the sensed temperature in a third operation mode.

15. The image forming apparatus according to claim 14, wherein the controller further controls the temperature of the fixing means in accordance with a fourth temperature gradient relationship of the sensed temperature in a fourth operation mode.

16. The image forming apparatus according to claim 15, wherein the fourth operation mode is a thick paper image forming mode.

17. The image forming apparatus according to claim 12, wherein the controller further controls a temperature of the pressure means in accordance with a third temperature gradient relationship of the sensed environment temperature.

18. The image forming apparatus according to claim 12, wherein the controller further controls a temperature of the pressure means in accordance with a third temperature gradient relationship of the sensed environment temperature in the first operation mode and further controls the temperature of the pressure means in accordance with a fourth temperature gradient relationship, different than the third relationship, of the sensed environment temperature in the second operation mode.

19. The image forming apparatus according to claim 18, wherein the first operation mode is a full-color image forming operation mode and the second operation mode is a non-full color image forming operation mode.

20. The image forming apparatus according to claim 18, wherein the controller further controls the temperature of the pressure means in accordance with a fifth temperature gradient relationship of the sensed temperature in a third operation mode.

21. The image forming apparatus according to claim 20, wherein the controller further controls the temperature of the pressure means in accordance with a sixth temperature gradient relationship of the sensed temperature in a fourth operation mode.

22. The image forming apparatus according to claim 21, wherein the fourth operation mode is a thick paper image forming mode.

23. An image forming apparatus method comprising the steps of:

fixing an image on a recording medium by passing the recording medium between a fixing roller and a pressure roller;

controlling a temperature of the fixing roller in accordance with a first temperature gradient relationship of a sensed environment temperature in a first operation mode of the image forming apparatus and controlling said temperature of the fixing roller in accordance with a second temperature gradient relationship, different than the first temperature gradient relationship, of the sensed environment temperature in a second operation mode different than the first operation mode.

24. The image forming method according to claim 23, wherein in the controlling step the first operation mode is a full-color image forming operation mode and the second operation mode is a non-full color image forming operation mode.

25. The image forming method according to claim 23, wherein the controlling step further controls the temperature of the fixing roller in accordance with a third temperature gradient relationship of the sensed temperature in a third operation mode.

26. The image forming apparatus according to claim 25, wherein the controlling step further controls the temperature of the fixing roller in accordance with a fourth temperature gradient relationship of the sensed temperature in a fourth operation mode.

27. The image forming apparatus according to claim 26, wherein in the controlling step the fourth operation mode is a thick paper image forming mode.

28. The image forming apparatus according to claim 23, wherein the controlling step further controls a temperature of the pressure roller in accordance with a third temperature gradient relationship of the sensed environment temperature.

29. The image forming apparatus according to claim 23, wherein the controlling step further controls a temperature of the pressure roller in accordance with a third temperature gradient relationship of the sensed environment temperature in the first operation mode and further controls the temperature of the pressure roller in accordance with a fourth temperature gradient relationship, different than the third temperature gradient relationship, of the sensed environment temperature in the second operation mode.

30. The image forming apparatus according to claim 29, wherein in the controlling step the first operation mode is a full-color image forming operation mode and the second operation mode is a non-full color image forming operation mode.

31. The image forming apparatus according to claim 29, wherein the controlling step further controls the temperature of the pressure roller in accordance with a fifth temperature gradient relationship of the sensed temperature in a third operation mode.

32. The image forming apparatus according to claim 31, wherein the controlling step further controls the temperature of the pressure roller in accordance with a sixth temperature gradient relationship of the sensed temperature in a fourth operation mode.

33. The image forming apparatus according to claim 32, wherein in the controlling step the fourth operation mode is a thick paper image forming mode.

34. An image forming apparatus, comprising:

a fixing roller;

a pressure roller facing the fixing roller; and a controller controlling a temperature of the fixing roller in accordance with a first temperature gradient relationship of a sensed environment temperature in a first operation mode of the image forming apparatus and controlling said temperature of the fixing roller in accordance with a second temperature gradient relationship, different than the first temperature gradient relationship, of the sensed environment temperature in a second operation mode different than the first operation mode, wherein the controller further controls the temperature of the fixing roller in accordance with a third temperature gradient relationship of the sensed temperature in a third operation mode, and wherein the third operation mode is a character image forming mode.

35. The image forming apparatus according to claim 34, wherein the first operation mode is a full-color image forming operation mode and the second operation mode is a non-full color image forming operation mode.

36. The image forming apparatus according to claim 34, wherein the controller further controls the temperature of the fixing roller in accordance with a fourth temperature gradient relationship of the sensed temperature in a fourth operation mode.

37. The image forming apparatus according to claim 36, wherein the fourth operation mode is a thick paper image forming mode.

38. The image forming apparatus according to claim 34, wherein the controller further controls a temperature of the pressure roller in accordance with a fourth temperature gradient relationship of the sensed environment temperature.

39. An image forming apparatus, comprising:

a fixing roller;

a pressure roller facing the fixing roller; and a controller controlling a temperature of the fixing roller in accordance with a first temperature gradient relationship of a sensed environment temperature in a first operation mode of the image forming apparatus and controlling said temperature of the fixing roller in accordance with a second temperature gradient relationship, different than the first temperature gradient relationship, of the sensed environment temperature in a second operation mode different than the first operation mode, wherein the controller further controls a temperature of the pressure roller in accordance with a third temperature gradient relationship of the sensed environment temperature in the first operation mode and further controls the temperature of the pressure roller in accordance with a fourth temperature gradient relationship, different than the third temperature gradient relationship, of the sensed environment temperature in the second operation mode, wherein the controller further controls the temperature of the pressure roller in accordance with a fifth temperature gradient relationship of the sensed temperature in a third operation mode, and wherein the third operation mode is a character image forming mode.

40. The image forming apparatus according to claim 39, wherein the first operation mode is a full-color image forming operation mode and the second operation mode is a non-full color image forming operation mode.

41. The image forming apparatus according to claim 39, wherein the controller further controls the temperature of the pressure roller in accordance with a sixth temperature gradient relationship of the sensed temperature in a fourth operation mode.

42. The image forming apparatus according to claim 41, wherein the fourth operation mode is a thick paper image forming mode.

43. An image forming apparatus, comprising:

means for fixing an image on a recording medium, and including a fixing means and a pressure means; and control means for controlling a temperature of the fixing means in accordance with a first temperature gradient relationship of a sensed environment temperature in a first operation mode of the image forming apparatus and controlling said temperature of the fixing means in accordance with a second temperature gradient relationship, different than the first temperature gradient relationship, of the sensed environment temperature in a second operation mode different than the first operation mode, wherein the controller further controls the temperature of the fixing means in accordance with a third temperature gradient relationship of the sensed temperature in a third operation mode, and wherein the third operation mode is a character image forming mode.

44. The image forming apparatus according to claim 43, wherein the first operation mode is a full-color image forming operation mode and the second operation mode is a non-full color image forming operation mode.

45. The image forming apparatus according to claim 43, wherein the controller further controls the temperature of the fixing means in accordance with a fourth temperature gradient relationship of the sensed temperature in a fourth operation mode.

46. The image forming apparatus according to claim 45, wherein the fourth operation mode is a thick paper image forming mode.

47. The image forming apparatus according to claim 43, wherein the controller further controls a temperature of the pressure means in accordance with a fourth temperature gradient relationship of the sensed environment temperature.

48. An image forming apparatus, comprising:

means for fixing an image on a recording medium, and including a fixing means and a pressure means; and control means for controlling a temperature of the fixing means in accordance with a first temperature gradient relationship of a sensed environment temperature in a first operation mode of the image forming apparatus and controlling said temperature of the fixing means in accordance with a second temperature gradient relationship, different than the first temperature gradient relationship, of the sensed environment temperature in a second operation mode different than the first operation mode, wherein the controller further controls a temperature of the pressure means in accordance with a third temperature gradient relationship of the sensed environment temperature in the first operation mode and further controls the temperature of the pressure means in accordance with a fourth temperature gradient relationship, different than the third relationship, of the sensed environment temperature in the second operation mode, wherein the controller further controls the temperature of the pressure means in accordance with a fifth temperature gradient relationship of the sensed temperature in a third operation mode, and wherein the third operation mode is a character image forming mode.

49. The image forming apparatus according to claim 48, wherein the first operation mode is a full-color image forming operation mode and the second operation mode is a non-full color image forming operation mode.

50. The image forming apparatus according to claim 48, wherein the controller further controls the temperature of the pressure means in accordance with a sixth temperature gradient relationship of the sensed temperature in a fourth operation mode.

51. The image forming apparatus according to claim 50, wherein the fourth operation mode is a thick paper image forming mode.

52. An image forming apparatus method, comprising the steps of:

fixing an image on a recording medium by passing the recording medium between a fixing roller and a pressure roller; and controlling a temperature of the fixing roller in accordance with a first temperature gradient relationship of a sensed environment temperature in a first operation mode of the image forming apparatus and controlling said temperature of the fixing roller in accordance with a second temperature gradient relationship, different than the first temperature gradient relationship, of the sensed environment temperature in a second operation mode different than the first operation mode, wherein the controlling step further controls the temperature of the fixing roller in accordance with a third temperature gradient relationship of the sensed temperature in a third operation mode, and wherein in the controlling step the third operation mode is a character image forming mode.

53. The image forming method according to claim 52, wherein in the controlling step the first operation mode is a full-color image forming operation mode and the second operation mode is a non-full color image forming operation mode.

54. The image forming apparatus according to claim 52, wherein the controlling step further controls the temperature of the fixing roller in accordance with a fourth temperature gradient relationship of the sensed temperature in a fourth operation mode.

55. The image forming apparatus according to claim 54, wherein in the controlling step the fourth operation mode is a thick paper image forming mode.

56. The image forming apparatus according to claim 52, wherein the controlling step further controls a temperature of the pressure roller in accordance with a fourth temperature gradient relationship of the sensed environment temperature.

57. An image forming apparatus method, comprising the steps of:

fixing an image on a recording medium by passing the recording medium between a fixing roller and a pressure roller; and controlling a temperature of the fixing roller in accordance with a first temperature gradient relationship of a sensed environment temperature in a first operation mode of the image forming apparatus and controlling said temperature of the fixing roller in accordance with a second temperature gradient relationship, different than the first temperature gradient relationship, of the sensed environment temperature in a second operation mode different than the first operation mode, wherein the controlling step further controls a temperature of the pressure roller in accordance with a third temperature gradient relationship of the sensed environment temperature in the first operation mode and further controls the temperature of the pressure roller in accordance with a fourth temperature gradient relationship, different than the third temperature gradient relationship, of the sensed environment temperature in the second operation mode, wherein the controlling step further controls the temperature of the pressure roller in accordance with a fifth temperature gradient relationship of the sensed temperature in a third operation mode, and wherein in the controlling step the third operation mode is a character image forming mode.

58. The image forming method according to claim 57, wherein in the controlling step the first operation mode is a full-color image forming operation mode and the second operation mode is a non-full color image forming operation mode.

59. The image forming apparatus according to claim 57, wherein the controlling step further controls the temperature of the fixing roller in accordance with a sixth temperature gradient relationship of the sensed temperature in a fourth operation mode.

60. The image forming apparatus according to claim 59, wherein in the controlling step the fourth operation mode is a thick paper image forming mode.

61. An image forming apparatus, comprising:

a fixing roller;

a pressure roller facing the fixing roller;

a controller controlling a temperature of the fixing roller in accordance with a first temperature gradient relationship of a sensed environment temperature in a first operation mode of the image forming apparatus and controlling said temperature of the fixing roller in accordance with a second temperature gradient relationship, different than the first temperature gradient relationship, of the sensed environment temperature in a second operation mode different than the first operation mode, wherein at least one of the first operation mode and the second operation mode is a character image forming mode.

62. An image forming apparatus, comprising:

means for fixing an image on a recording medium, and including a fixing means and a pressure means; and control means for controlling a temperature of the fixing means in accordance with a first temperature gradient relationship of a sensed environment temperature in a first operation mode of the image forming apparatus and controlling said temperature of the fixing means in accordance with a second temperature gradient relationship, different than the first temperature gradient relationship, of the sensed environment temperature in a second operation mode different than the first operation mode, wherein at least one of the first operation mode and the second operation mode is a character image forming mode.

63. An image forming apparatus method, comprising the steps of:

fixing an image on a recording medium by passing the recording medium between a fixing roller and a pressure roller;

controlling a temperature of the fixing roller in accordance with a first temperature gradient relationship of a sensed environment temperature in a first operation mode of the image forming apparatus and controlling said temperature of the fixing roller in accordance with a second temperature gradient relationship, different than the first temperature gradient relationship, of the sensed environment temperature in a second operation mode different than the first operation mode, wherein in the controlling step at least one of the first operation mode and the second operation mode is a character image forming mode.

* * * * *